US009290014B2

(12) United States Patent
Ohkawa et al.

(10) Patent No.: US 9,290,014 B2
(45) Date of Patent: Mar. 22, 2016

(54) INKJET RECORDING APPARATUS

(75) Inventors: Masakatsu Ohkawa, Tomi (JP); Tomotaka Furuhata, Tomi (JP)

(73) Assignee: MIMAKI ENGINEERING CO., LTD., Tomi, Nagano (JP)

( * ) Notice: Subject to any disclaimer, the term of this patent is extended or adjusted under 35 U.S.C. 154(b) by 323 days.

(21) Appl. No.: 13/880,737

(22) PCT Filed: Oct. 21, 2011

(86) PCT No.: PCT/JP2011/074352

§ 371 (c)(1),
(2), (4) Date: Jul. 1, 2013

(87) PCT Pub. No.: WO2012/053647

PCT Pub. Date: Apr. 26, 2012

(65) Prior Publication Data

US 2013/0271541 A1 Oct. 17, 2013

(30) Foreign Application Priority Data

Oct. 22, 2010 (JP) ..... 2010-237439

(51) Int. Cl.
*B41J 11/00* (2006.01)

(52) U.S. Cl.
CPC ..... *B41J 11/002* (2013.01)

(58) Field of Classification Search
CPC ..... B41J 11/002
USPC ..... 347/102; 34/275
See application file for complete search history.

(56) References Cited

U.S. PATENT DOCUMENTS

2005/0168555 A1* 8/2005 Niekawa ..... 347/102
2006/0023045 A1* 2/2006 Yokoyama et al. ..... 347/102
2008/0174648 A1* 7/2008 Nakano et al. ..... 347/102

FOREIGN PATENT DOCUMENTS

CN 101180185 5/2008
JP 2004-188920 A 7/2004

(Continued)

OTHER PUBLICATIONS

International Search Report in International Application No. PCT/JP2011/074352, dated Nov. 15, 2011.

(Continued)

*Primary Examiner* — Manish S Shah
*Assistant Examiner* — Roger W Pisha, II
(74) *Attorney, Agent, or Firm* — Park, Kim & Suh, LLC

(57) ABSTRACT

An inkjet recording apparatus 1 which is able to print high quality images by changing ultraviolet intensity in the sub-scanning direction. The inkjet recording apparatus 1 includes a carriage moving back and forth in the main scanning direction, inkjet heads 5 mounted on the carriage 4 for discharging ink droplets, and an ultraviolet irradiator 6 mounted on the carriage 4 for irradiating ultraviolet rays. The ultraviolet irradiators 6 include a plurality of UVLEDs 63 provided on a center of a bottom surface of a concave portion 62 of the irradiators 6 and arranged in the sub-scanning direction, and a plurality of partition walls 64 provided between the UVLEDs 63 and having a flat plate shape extended in the main scanning direction. The ultraviolet intensity in the sub-scanning direction can be changed by controlling each UVLED 63.

11 Claims, 19 Drawing Sheets

(56) References Cited

FOREIGN PATENT DOCUMENTS

| | | | |
|---|---|---|---|
| JP | 2004-188923 | A | 7/2004 |
| JP | 2004-237588 | A | 8/2004 |
| JP | 2004-358674 | A | 12/2004 |
| JP | 2007-210169 | A | 8/2007 |
| JP | 2009-202418 | A | 9/2009 |
| JP | 2010-149381 | A | 7/2010 |
| JP | 2010-173308 | A | 8/2010 |

OTHER PUBLICATIONS

Chinese Office Action in Appln. No. 201180062180.0 dated Sep. 2, 2014.

Chinese Office Action in Appln. No. 201180062180.0 dated May 6, 2015.

Japanese Office Action in Appln. No. 2012-539787 dated Mar. 14, 2014.

* cited by examiner (A)

(B)

INKJET RECORDING APPARATUS

CROSS-REFERENCE TO RELATED APPLICATIONS

This application is the National Stage filing under 35 U.S.C. 371 of International Application No. PCT/JP2011/074352, filed on Oct. 21, 2011, which claims the benefit of Japanese Patent Application No. 2010-237439, filed on Oct. 22, 2010, the contents of which are all hereby incorporated by reference herein in their entirety.

TECHNICAL FIELD

The present disclosure relates to an inkjet recording apparatus discharging ultraviolet-curable ink.

BACKGROUND ART

Patent document 1 discloses an ink recording apparatus that uses ultraviolet-curable ink. An ultraviolet irradiating device mounted to the ink recording apparatus includes a plurality of light sources for ultraviolet rays on a line extended in a sub-scanning direction and arranged in a main scanning direction inside a box-shaped cover. The cover has an opening area towards a recording medium. Ultraviolet rays reaching a recording head are reduced because an ultraviolet light absorber is attached to the inner surface of the box-shaped cover, and flat plate-shaped partition members extended in the sub-scanning direction are mounted such that the cover is divided into three areas.

PRIOR ART DOCUMENTS

Patent Documents

Patent Document 1: Japanese Patent Publication No. 2004-188923

DISCLOSURE OF INVENTION

Technical Problem

The conventional inkjet recording apparatuses cannot change the intensity of ultraviolet ray irradiation in the sub-scanning direction. For multi-path printing using a plurality of paths to record a band of image, printing quality cannot be improved because the intensity of ultraviolet ray irradiation is the same for neighboring bands which are close to each other in the sub-scanning direction.

In other words, in the patent document 1, since partition members to which the ultraviolet ray absorber is attached are mounted in the ultraviolet irradiator, the ultraviolet rays from the ultraviolet light sources can be blocked from a nozzle surface of a recording head. However, even though the ultraviolet rays in the main scanning direction can be blocked, the ultraviolet rays in the sub-scanning direction cannot be blocked because the partition members are formed as a plate shape extended in the sub-scanning direction. Thus, in the patent document 1, printing quality cannot be improved because the intensity of ultraviolet ray irradiation is the same for neighboring bands which are close to each other in the sub-scanning direction.

Inventors of the present disclosure realized from a research on printing quality that printing quality varies depending on the curing conditions of ultraviolet-curable ink.

Therefore, the present disclosure is to provide an inkjet recording apparatus to obtain desired printing quality by altering the intensity of ultraviolet ray irradiation in the sub-scanning direction.

Technical Solution

According to an embodiment of the present disclosure, an inkjet recording apparatus includes a carriage moving back and forth in a main scanning direction, ink discharging means mounted on the carriage and including a plurality of ink nozzles arranged in a sub-scanning direction for discharging ultraviolet-curable ink on a recording medium, and ultraviolet irradiating means mounted on the carriage for irradiating ultraviolet rays on the medium. The carriage or the medium moves in the sub-scanning direction which is perpendicular to the main scanning direction. In addition, the ultraviolet irradiating means includes a plurality of light sources arranged in the sub-scanning direction for irradiating the ultraviolet rays, and a plurality of partition walls blocking ultraviolet irradiation of the light sources in the sub-scanning direction.

According to the embodiment of the present disclosure, the ultraviolet irradiation intensity in the sub-scanning direction is altered by turning on and off the light sources because the plurality of the light sources are arranged in the sub-scanning direction and the ultraviolet ray irradiation in the sub-scanning direction is blocked by the partition wall. For example, for obtaining matte image, ink droplets are irradiated by ultraviolet rays after being deposited on a recording medium. For obtaining gloss image, ink droplets are irradiated not after the ink droplets are deposited but after the deposited ink droplets are sufficiently smoothened on the recording medium. In case that color ink is discharged from ink nozzles in the forward region in the sub-scanning direction and clear ink is discharged from ink nozzles in the backward region in the sub-scanning direction, the matte image can be obtained by irradiating the ultraviolet rays from all the light sources. The gloss image can be obtained by irradiating the ultraviolet rays from the light sources not in the backward region but in the forward region in the sub-scanning direction. Therefore, desired printing quality can be obtained by altering the intensity of ultraviolet ray irradiation in the sub-scanning direction by the plurality of the light sources and the partition walls.

It is preferred that the plurality of ink nozzles include a plurality of path areas to record a plurality of bands, the plurality of light sources irradiate the ultraviolet rays on the plurality of bands, respectively, and each partition wall blocks ultraviolet irradiation of a light source on a band other than a corresponding band. Thus, desired printing quality can be obtained because the ultraviolet irradiation intensity for the plurality of the bands can be controlled. For example, there are ink nozzles discharging only color ink and ink nozzles discharging only clear ink, all of which are mounted to the carriage. The color ink can be cured and clear ink can be smoothened in a single scan because the light sources corresponding to the bands of the color ink, respectively, are turned on while the light sources corresponding to the bands of the clear ink, respectively, are turned off. Therefore, the color ink records matte image and the clear ink records gloss image.

It is preferred that the light sources include a plurality of ultraviolet light emitting diodes (UVLEDs) arranged in the sub-scanning direction, and the partition walls are provided to form a plurality of shielded portions extended in the main scanning direction. Thus, the heat of ultraviolet rays can be reduced by using the UVLEDs. Since the light sources can be promptly turned on and off, energy can be saved by irradiating the ultraviolet rays only when the irradiation is needed. Moreover, the ultraviolet ray irradiation in the sub-scanning direction can be properly blocked because the ultraviolet rays in the sub-scanning direction are blocked by the partition walls.

It is preferred that a concave portion is provided on a side of the ultraviolet irradiating means facing the recording medium, the light sources are provided on a bottom surface of the concave portion, and the partition walls are provided such that the shielded portions extends from the bottom surface to an opening area of the concave portion. Thus, the direction of the ultraviolet ray irradiation can be broadened in the scanning direction because the concave portion is formed downward from a bottom side of the main body of the carriage facing the recording medium of the ultraviolet irradiating means and the UVLEDs are arranged on the bottom surface of the concave portion. Thus, small UVLEDs can be used to irradiate ultraviolet rays for a longer period of time. Moreover, since the partition walls are formed from the bottom of the concave portion to the opening area, the ultraviolet rays irradiated from the UVLEDs are prevented from being irradiated in the sub-scanning direction over the partition walls.

It is preferred that the partition walls are removably insertable into the ultraviolet irradiating means. Thus, the more delicate distribution of the ultraviolet ray irradiation can be achieved because the ultraviolet ray irradiation at any positions in the sub-scanning direction can be altered.

It is preferred that the inkjet recording apparatus further includes a light controller turning on and off the light sources. Thus, various image qualities can be obtained by only one inkjet recording apparatus because the light controller can turn on and off each one of the light sources.

It is preferred that the ultraviolet irradiating means is provided in at least one of front and rear regions of the ink nozzles in the main scanning direction. Thus, all ink droplets discharged from the ink nozzles can be cured by moving the carriage forward and backward through a single scan in the main scanning direction.

Advantageous Effects

According to the present disclosure, desired printing quality can be obtained by altering ultraviolet ray irradiation in a sub-scanning direction perpendicular to a main scanning direction.

BEST MODE FOR CARRYING OUT THE INVENTION

Reference will now be made in detail to the preferred embodiments of the present disclosure, examples of which are illustrated in the accompanying drawings. Wherever possible, the same reference numbers will be used throughout the drawings to refer to the same or like parts. An inkjet recording apparatus 1 according to an embodiment of the present disclosure is an inkjet printer that uses ultraviolet-curable ink (hereinafter, "UV ink") to print an image on a medium by using a multi-path recording method in which each image band is recorded by a plurality of paths.

Figure 1:
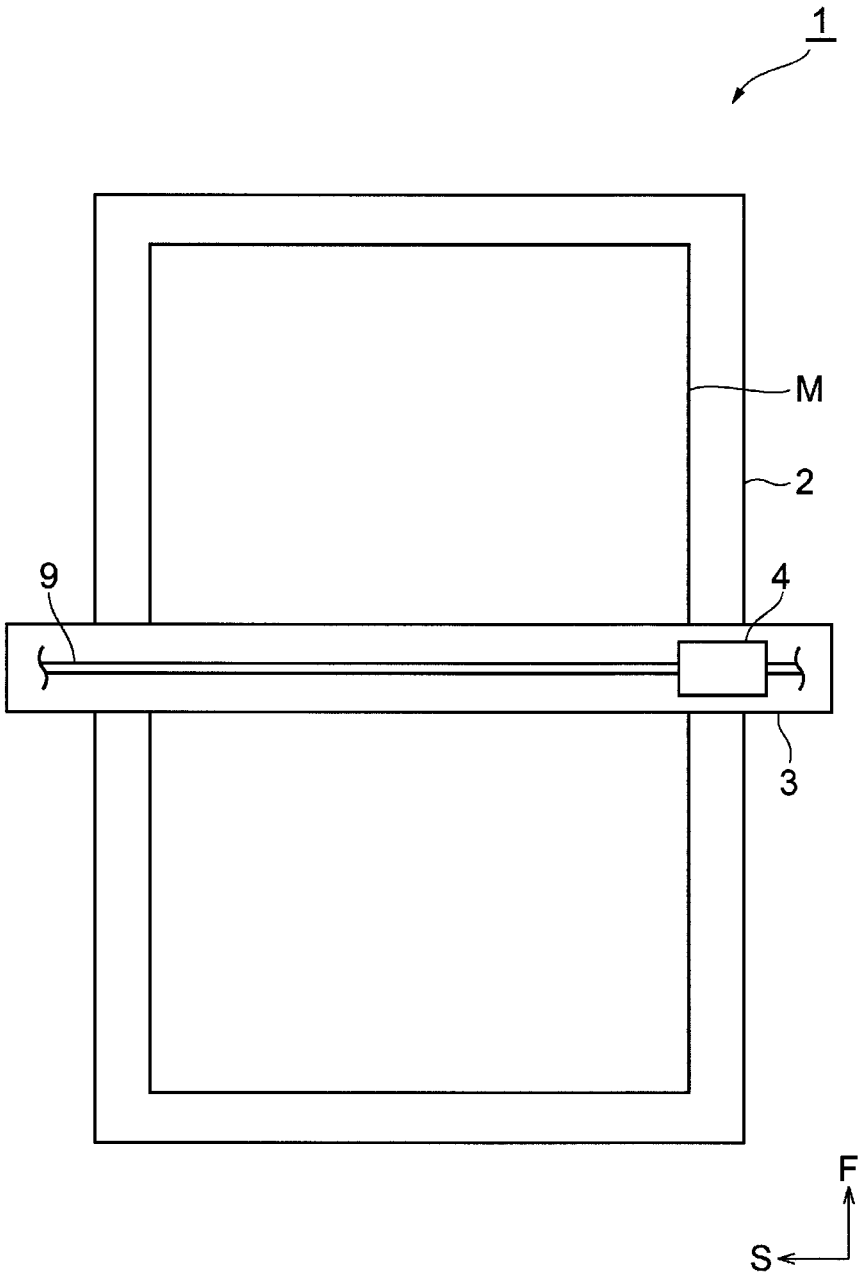
FIG. 1 illustrates an inkjet recording apparatus according to an embodiment of the present disclosure.
Figure 2:
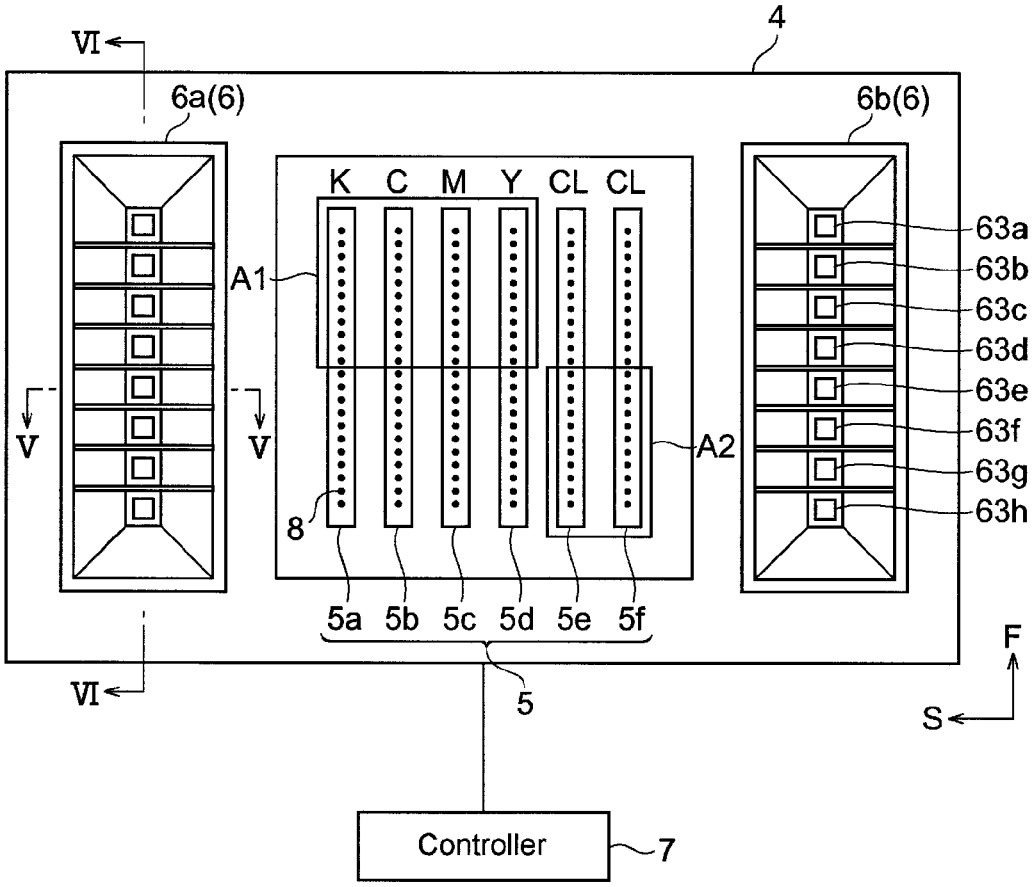
FIG. 2 is an enlarged view of the carriage shown in FIG. 1.

FIG. 1 illustrates the inkjet apparatus 1 according to the embodiment of the present disclosure, and FIG. 2 illustrates a carriage 4 shown in FIG. 1. Referring to FIGS. 1 and 2, the inkjet recording apparatus 1 includes a flat bed 2 on which a recording medium (M) is placed, a Y bar 3 which moves back and forth in a sub-scanning direction (F) over the flat bed 2, and the carriage 4 which is mounted on the Y bar 3 and moves back and forth in a main scanning direction (S). The recording apparatus 1 further includes a plurality of inkjet heads 5 (5*a* to 5*f*) mounted on the carriage 4 for discharging ink droplets, a pair of ultraviolet irradiators 6 (6*a* and 6*b*) mounted on the carriage 4 and positioned in the forward (left in FIG. 2) and backward (right in FIG. 2) regions in the main scanning direction (S) with respect to the inkjet heads 5 as shown in FIG. 2, and a controller 7 which controls the overall operation of the inkjet recording apparatus 1. The main scanning direction (S) is a direction in which the carriage 4 moves to record images bands on the recording medium. The sub-scanning direction (F) is a direction in which the Y bar 3 moves with respect to the medium in order to change locations of the image bands being recorded on the medium. The Y bar 3 carries the carriage 4 in the sub-scanning direction (F) for each predetermined path width and the carriage 4 moves back and forth in the main scanning direction (S) under the control of the controller 7 to record an image on the medium. During the recordation, the inkjet heads 5 discharge the ultraviolet-curable ink on the medium and the pair of ultraviolet irradiators 6 irradiate ultraviolet rays on the discharged ink. When the carriage 4 moves "forward" in the main scanning direction (S), it moves in the main scanning direction (S) (toward left in FIG. 1). When the carriage 4 moves "backward" in the main scanning direction (S), it moves in a direction opposite to the main scanning direction (S) (toward right in FIG. 1). In addition, when the Y 3 bar moves "forward" in the sub-scanning direction (F), it moves in the sub-scanning direction (F) (toward up in FIG. 1). When the Y bar 3 moves "backward" in the sub-scanning direction (F), it moves in a direction opposite to the sub-scanning direction (F) (toward down in FIG. 1).

The Y bar 3 carries the carriage 4 in the sub-scanning direction (F) with respect to the flat bed 2. For example, the Y bar 3 can be moveably mounted on a guide rail (not illustrated) extended in the sub-scanning direction (F) and can be coupled with a driving device such as a driving motor (not illustrated) to move back and forth in the sub-scanning direction (F). When the Y bar 3 moves forward in the sub-scanning direction (F), it moves from an upstream region (lower region in FIG. 1) to a downstream region (upper region in FIG. 1). In other words, the region from which it moves is called an upstream region and the region to which it moves is called a downstream region. Similarly, when the Y bar 3 moves backward in the sub-scanning direction (F), it also moves from an upstream region (upper region in FIG. 1) to a downstream region (lower region in FIG. 1). In other words, the region from which it moves is called an upstream region and the region to which it moves is called a downstream region.

The carriage 4 carries the inkjet heads 5 and the ultraviolet irradiators 6 in the main scanning direction (S) with respect to the flat bed 2. For example, the carriage 4 can be movably mounted on a guide rail 9 extended in the main scanning direction (S) as shown in FIG. 1 and can be coupled with a driving device such as a driving motor (not illustrated) such that it can move back and forth in the main scanning direction (S). When the carriage 4 moves forward in the main scanning direction (S), it moves from an upstream region to a downstream region. In other words, the region from which it moves is called an upstream region and the region to which it moves is called a downstream region. Similarly, when the carriage 4 moves backward in the main scanning direction (S), it moves from an upstream region to a downstream region. Similarly, the region from which it moves is called an upstream region and the region to which it moves is called a downstream region.

Referring to FIG. 2, the inkjet heads 5*a*-5*f* are aligned in the sub-scanning direction (F). The inkjet heads 5*a*, 5*b*, 5*c*, 5*d*, 5*e* and 5*f* are sequentially arranged in the order shown in FIG. 2. Since the inkjet heads 5 are mounted on the carriage 4, the inkjets heads 5 are able to discharge the ultraviolet-curable ink while they move in the main scanning direction (S).

Each inkjet head 5 includes a plurality of ink nozzles 8 which discharge ultraviolet-curable ink droplets. They are aligned in a nozzle line which is parallel to the sub-scanning direction (F). Referring to FIG. 2, each nozzle 8 of the inkjet heads 5*a*, 5*b*, 5*c*, and 5*d* located in the forward region (front region) in the main scanning direction (S) discharges color ultraviolet-curable ink (color ink). On the other hand, each nozzle 8 of the inkjet heads 5*e* and 5*f* located in the backward region (rear region) discharges clear ultraviolet-curable ink (clear ink). More particularly, each ink nozzle 8 of the inkjet heads 5*a*, 5*b*, 5*c*, and 5*d* discharges black (K), cyan (C), magenta (M), and yellow (Y) color inks, respectively. Each ink nozzle 8 of the inkjet heads 5*e* and 5*f* discharges clear ink (CL).

Only the ink nozzles of the inkjet heads 5*a*-5*d* located in a first discharge area A1 (forward region in the sub-scanning direction) discharge the color ink, and no color ink is discharged from other ink nozzles of the inkjet heads 5*a*-5*d* located in the backward region in the sub-scanning direction (F). Similarly, only the ink nozzles of the inkjet heads 5*e* and 5*f* located in a second discharge area A2 (backward region in the sub-scanning direction) discharge the clear ink. No clear ink is discharged from other ink nozzles of the inkjet heads 5*e* and 5*f* located in the forward region in the sub-scanning direction (F). Therefore, when the Y bar 3 moves in the sub-scanning direction (F), the color ink droplets discharged from the first discharge area A1 are recorded first on the medium placed on the flat bed 2. Thereafter, the clear ink droplets discharged from the discharge area A2 are recorded on the surface (upper layer) of the color ink recorded.

The ultraviolet irradiator 6*a* is located in the forward region in the main scanning direction (S) with respect to the inkjet heads 5, and the ultraviolet irradiator 6*b* is located in the backward region in the main scanning direction (S) with respect to the inkjet heads 5. The ultraviolet irradiators 6*a* and 6*b* are identical, and they irradiate ultraviolet rays to the ultraviolet-curable ink recorded on the medium to cure the recorded ink. For that reason, each of the irradiators 6*a* and 6*b* will be simply referred to as an ultraviolet irradiator 6. Since the ultraviolet irradiator 6 is mounted on the carriage 4 as shown in FIG. 2, it is able to irradiate ultraviolet rays while it moves in the main scanning direction (S).

Figure 3:
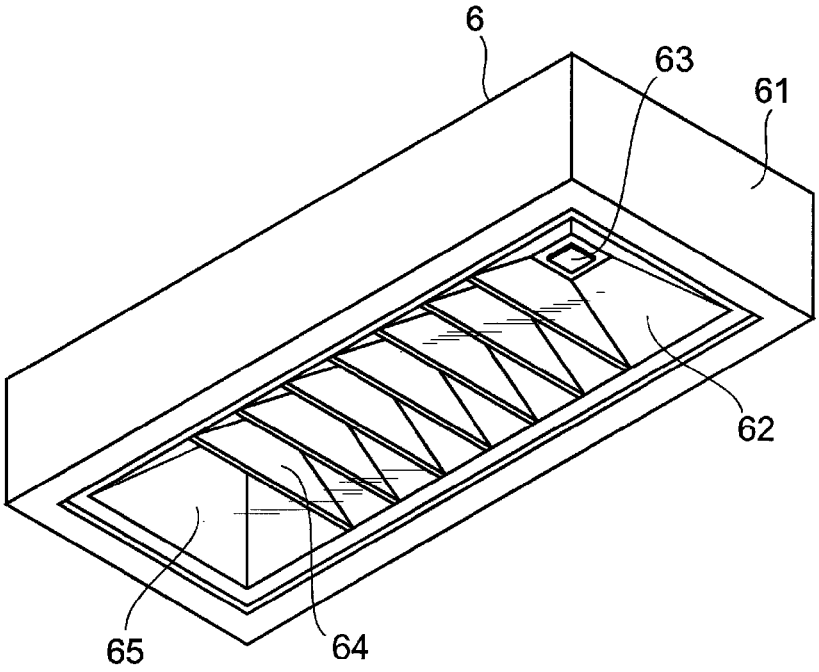
FIG. 3 is a perspective view of an ultraviolet irradiator with partition walls provided therein.
Figure 4:
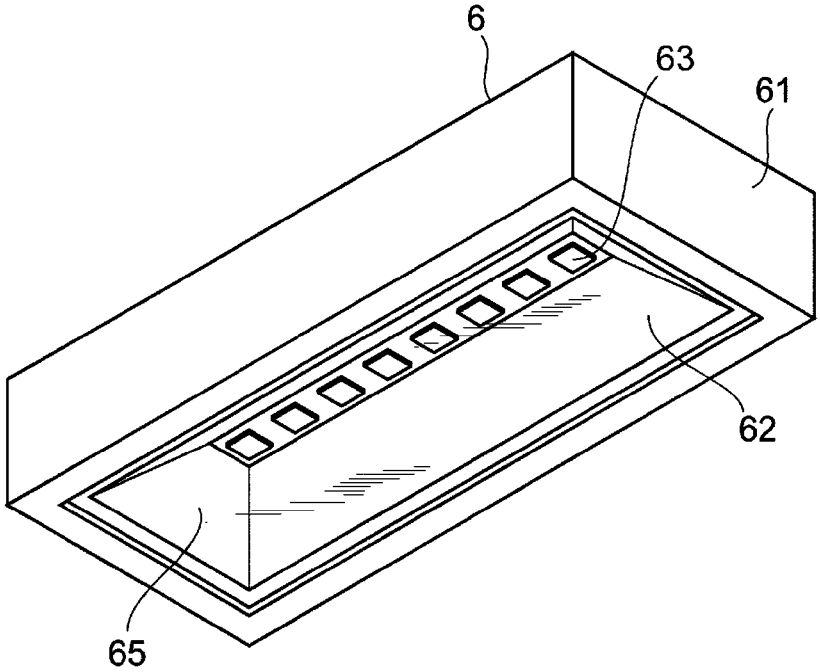
FIG. 4 is a perspective view of an ultraviolet irradiator without partition walls provided therein.
Figure 5:
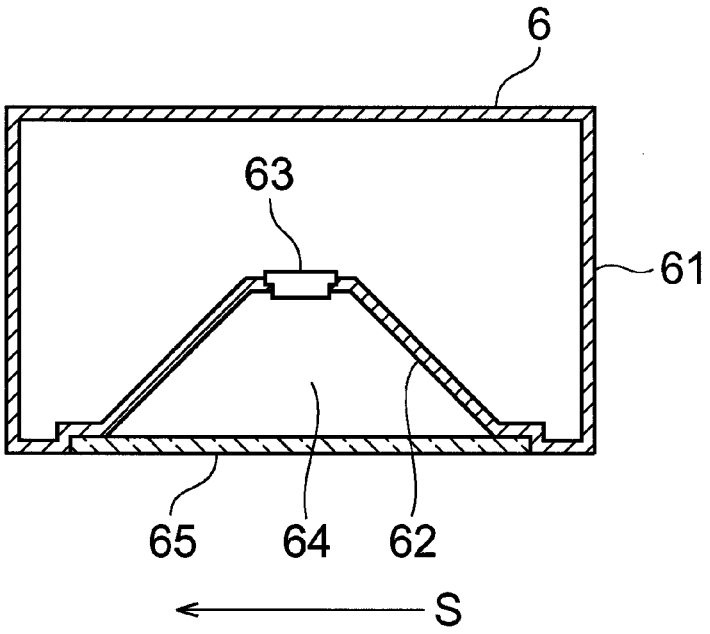
FIG. 5 is a cross-sectional view of the ultraviolet irradiator taken along line V-V shown in FIG. 2.
Figure 6:
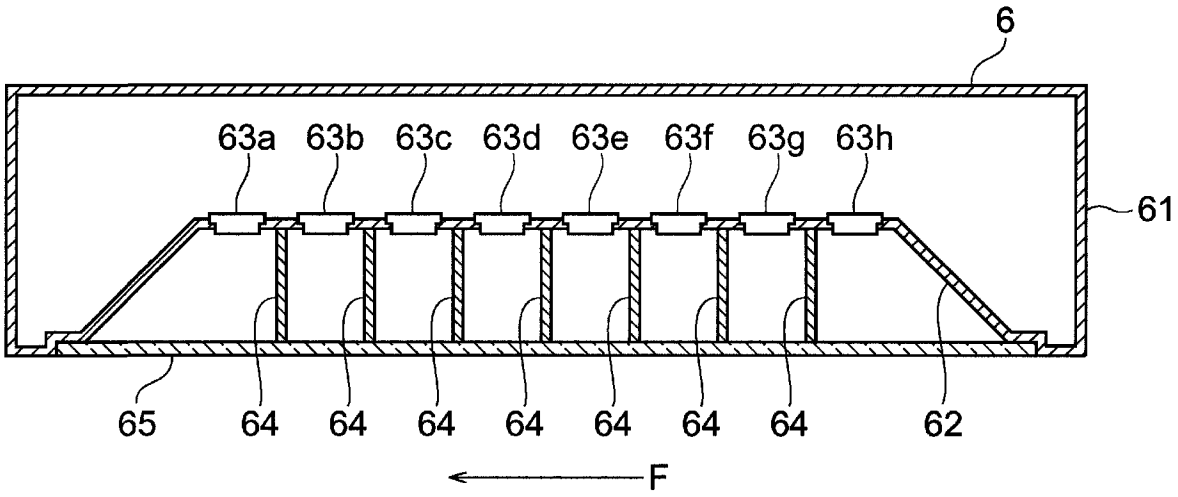
FIG. 6 is a cross-sectional view of the ultraviolet irradiator taken along line VI-VI shown in FIG. 2.

FIG. 3 is a perspective view of the ultraviolet irradiator 6 shown in FIG. 2 with partition walls 64, and FIG. 4 is a perspective view of the ultraviolet irradiator 6 shown in FIG. 2 without the partition walls 64. FIG. 5 is a cross-sectional view of the ultraviolet irradiator 6 taken along line V-V shown in FIG. 2, and FIG. 6 is a cross-sectional view of the ultraviolet irradiator 6 taken along line VI-VI shown in FIG. 2.

Referring to FIGS. 2 to 6, the ultraviolet irradiator 6 includes a main body 61, a concave portion 62 provided on the bottom side of the main body 61 facing the medium, a plurality of ultraviolet light emitting diodes (UVLEDs) 63 provided in the concave portion 62, and a plurality of partition walls 64 provided in the concave portion 62.

As shown in FIG. 5, the concave portion 62 reflects the ultraviolet rays emitted from the UVLEDs 63 vertically downward toward the flat bed 2 and is mirror-surfaced. The concave portion 62 has a long and thin trapezoidal shape in the sub-scanning direction (F). More particularly, the concave portion 62 is a quadrangular pyramid having a larger opening area and a smaller bottom area (top area shown in FIG. 5). It has an umbrella shape in which each inside surface is sloped at about 60 degrees with respect to a plane parallel to the flat bed 2 as shown in FIG. 5. For this reason, the cross section of the concave portion 62 in the main scanning direction (S) has a trapezoidal shape with a smaller width as shown in FIG. 5, and the cross section of the concave portion 62 in the sub-scanning direction (F) has a trapezoidal shape with a larger width as shown in FIG. 6.

A transparent cover 65 (e.g. quartz glass) having translucency is inserted perpendicularly to a rectangular opening formed on the top area of the concave portion 62. Thus, the opening area of the concave portion 62 is shielded and the ultraviolet rays irradiated from the UVLEDs 63 are penetrated.

Each UVLED 63 is positioned on a most concave area of the bottom area of the concave portion 62 and aligned equally distanced apart on one line in the sub-scanning direction (F). Each one of the plurality of the UVLEDs 63 is located in positions corresponding to the first discharge area A1 of the inkjet heads 5*a*-5*d* and the second discharge area A2 of the inkjet heads 5*e* and 5*f* in the main scanning direction (S).

However, for multi-path printing by the inkjet recording apparatus 1, each one of a plurality of bands can be recorded in ink droplets discharged in multi-paths in the first discharge area A1 and the second discharge area A2. Thus, the first discharge area A1 and the second discharge area A2 become a path area.

Therefore, according to an embodiment of the present disclosure, eight UVLEDs 63 are mounted to the ultraviolet irradiators 6 and four ULVEDs 63 are arranged in the main scanning direction to correspond to each of the first discharge area A1 and each of the second discharge area A2, respectively. In other words, the discharged ink droplets from the first discharge area A1 deposited on the medium (M) can be cured by UVLEDs 63*a*, 63*b*, 63*c*, and 63*d*. When the carriage 4 moves in the main scanning direction (S) and the ink droplets are discharged from the first discharge area A1 to record a band, the UVLEDs 63*a*, 63*b*, 63*c*, and 63*d* are located in positions such that the recorded band by the first discharge area A1 can be cured by irradiating ultraviolet rays. Also, the discharged ink droplets from the second discharge area A2 deposited on the medium (M) are cured by the UVLEDs 63*e*, 63*f*, 63*g*, and 63*h*. When the carriage 4 moves in the main scanning direction (S) and the ink droplets are discharged from the second discharge area A2 to record a band, the UVLEDs 63*e*, 63*f*, 63*g*, and 63*h* are located in positions such that the recorded band by the second discharge area A2 can be cured by irradiating ultraviolet rays. The UVLED 63*a*, the UVLED 63*b*, the UVLED 63*c*, and the UVLED 63*d* are sequentially arranged in the sub-scanning direction (F) as shown in FIG. 2. The UVLED 63*e*, the UVLED 63*f*, the UVLED 63*g*, and the UVLED 63*h* are sequentially arranged in the sub-scanning direction (F). Thus, for eight multi-path printing, one UVLED 63 corresponds to one band, for four multi-path printing, two UVLEDs 63 correspond to one band, and for two multi-path printing, four UVLEDs correspond to one band.

Meanwhile, since ultraviolet rays having a high directivity are irradiated from each UVLED 63, the intensity having a direction of 60° with respect to the vertical direction is 50% of the intensity in the vertical direction.

The partition wall 64 controls ultraviolet irradiation in the sub-scanning direction (F). It is positioned upright in the vertical direction and has a flat panel shape extended in the main scanning direction (S). The partition wall 64 has a trapezoidal shape having substantially same sizes with the cross sectional area of the concave portion 62 in the main scanning direction (S). Also, it is attached to the inner surfaces of the concave portion 62 and has a shape that extends from the bottom area of the concave portion 62 to its opening area. Thus, a shielded portion is formed by inserting the partition wall 64 in the concave portion 62 because there is no gap between the partition wall 64 and the concave portion 62, and ultraviolet rays cannot be leaked. The partition wall 64 preferably extends as closely as possible to the opening area of the concave portion 62 to an extent that the cover 65 can be inserted without difficulty on the opening area of the concave portion 62. For example, the size of the partition wall 64 can be such that there is no gap between the partition wall 64 and the cover 65 inserted on the opening area.

Such partition wall 64 is positioned in between the neighboring UVLEDs 63 and mounted such that it can be individually inserted and removed for the ultraviolet irradiators 6. Thus, a maximum of seven partition walls 64 can be inserted in the ultraviolet irradiators 6 having the eight UVLEDs 63 (refer to FIG. 3) and all the partition walls 64 can be removed (refer to FIG. 4).

Figure 7:
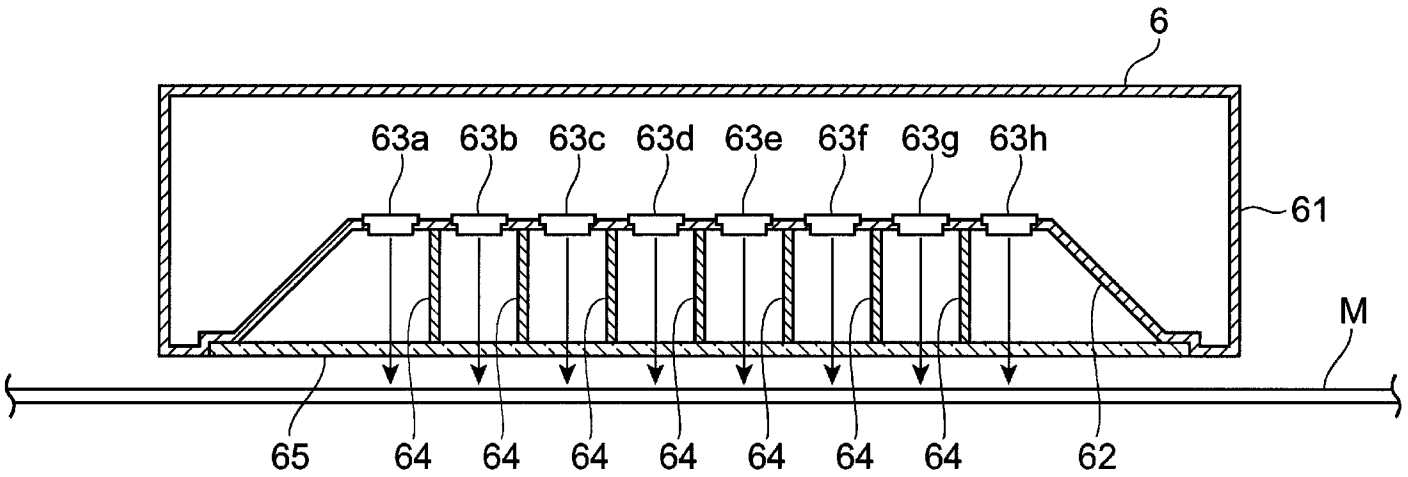
FIG. 7 illustrates an irradiating direction of ultraviolet rays where partition walls are provided between all UVLEDs.

FIG. 7 illustrates an irradiating direction of ultraviolet rays when the partition walls are inserted in between all the UVLEDs. As shown in FIG. 7, if the partition walls 64 are inserted in between all the UVLEDs 63, ultraviolet rays irradiated from each UVLED 63 are emitted only to a vertically downward region of each UVLED 63 in the sub-scanning direction (F) and are prevented from being emitted to vertically downward regions of the neighboring UVLEDs 63 in the sub-scanning direction (F). Thus, ultraviolet rays are irradiated to a portion of the medium (M) only from one of the UVLEDs 63 positioned vertically above the portion and ultraviolet rays are not irradiated from the neighboring UVLEDs 63.

The controller 7 controls the Y bar 3, the carriage 4, the inkjet head 5, and the ultraviolet irradiators 6 to record images on the medium (M) placed on the flat bed 2. Thus, the controller 7 records matte, glossy or thick images. A mode recording matte image is referred to as a matte image mode, and a mode recording glossy image is referred to as a gloss image mode, and a mode generating thick images is referred to as a thick image mode. For example, the controller 7 can be implemented by a computer including CPU, ROM, and RAM and each control of the controller 7 can be realized by enabling the computer to read and execute computer-readable program codes recorded on the CPU or RAM.

Figure 8:
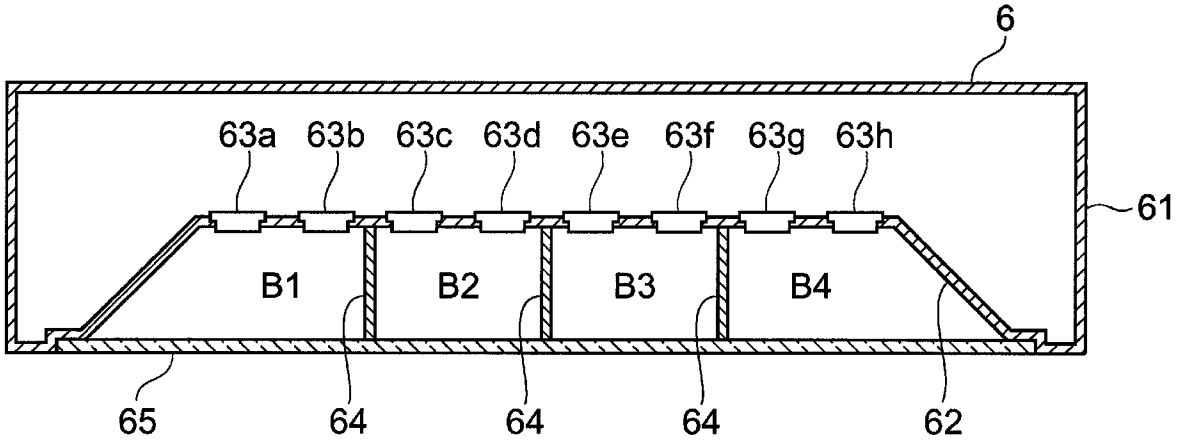
FIG. 8 is a cross-sectional view of the ultraviolet irradiator where three partition walls are provided at equally-distanced positions.
Figure 9:
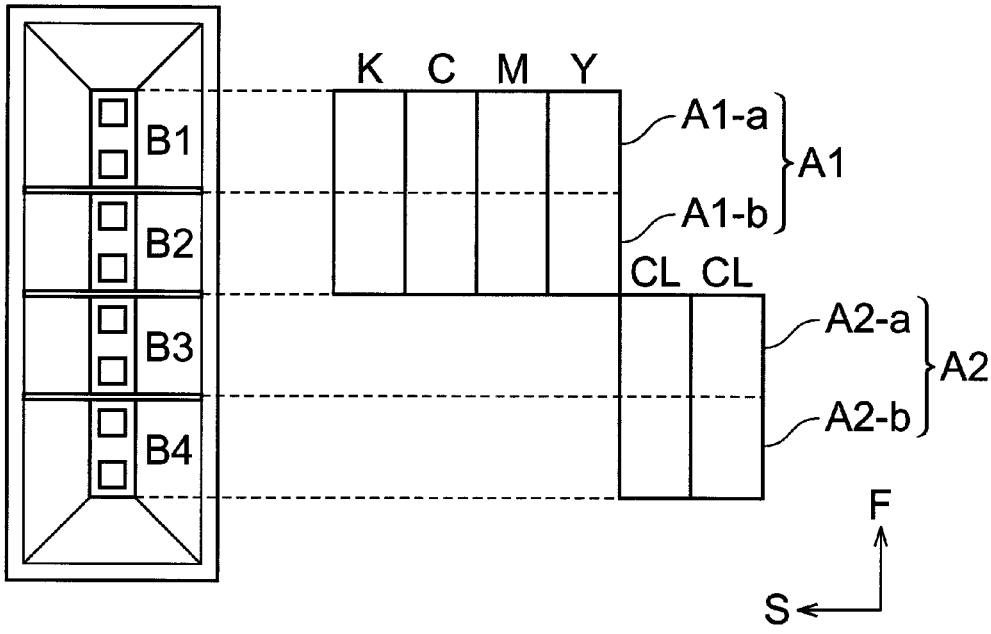
FIG. 9 is a diagram showing a relationship between the ultraviolet irradiator and inkjet heads.

A printing method by using the inkjet recording apparatus 1 will now be described. As shown in FIG. 8, three partition walls 64 are inserted equally distanced apart into the ultraviolet irradiators 6. A four multi-path printing is performed where two path color ink image recordation is made and two path clear ink image recordation is made. Thus, each of the first and the second discharge areas A1 and A2 in FIG. 2 records two bands. For convenience of explanation as shown in FIG. 9, the forward region of the first discharge area A1 in the sub-scanning direction (F) is referred as "the first discharge area A1-*a*" and the backward region of the first discharge area A1 in the sub-scanning direction (F) is referred as "the first discharge area A1-*b*". The forward region of the second discharge area A2 in the sub-scanning direction (F) is referred as "the second discharge area A2-*a*" and the backward region of the second discharge area A2 in the sub-scanning direction (F) is referred as "the second discharge area A2-*b*".

The concave portion 62 is divided into four areas by each partition wall 64. The UVLED 63*a* and the UVLED 63*b* are positioned in area B1, the UVLED 63*c* and the UVLED 63*d* are positioned in area B2, the UVLED 63*e* and the UVLED 63*f* are positioned in area B3, and the UVLED 63*g* and the UVLED 63*h* are positioned in area B4. Thus, as shown in FIG. 9, the area B1 corresponds to one band of the first discharge area A1-*a*, the area B2 corresponds to one band of the first discharge area A1-*b*, the area B3 corresponds to one band of the second discharge area A2-*a*, and the area B4 corresponds to one band of the second discharge area A2-*b*. In other words, the ink droplets discharged from the first discharge area A1-*a* deposited on the medium (M) are irradiated from the UVLEDs 63*a* and 63*b*, the ink droplets discharged from the first discharge area A1-*b* deposited on the medium (M) are irradiated from the UVLEDs 63*c* and 63*d*, the ink droplets discharged from the second discharge area A2-*a* deposited on the medium (M) are irradiated from the UVLEDs 63*e* and 63*f*, and the ink droplets discharged from the second discharge area A2-*b* deposited on the medium (M) are irradiated from the UVLEDs 63*g* and 63*h*. Thus, when the first discharge area A1 discharges ink droplets to record a band while the carriage 4 moves in the main scanning direction (S), the UVLEDs 63*a* and 63*b* of the area B1 are positioned in a position in which the band recorded from the first discharge area A1-*a* can be cured by irradiating ultraviolet rays. The UVLEDs 63*c* and 63*d* of the area B2 are positioned in a position in which the band recorded from the first discharge area A1-*b* can be cured by irradiating ultraviolet rays. The UVLEDs 63*e* and 63*f* of the area B3 are positioned in a position in which the band recorded from the second discharge area A2-*a* can be cured by irradiating ultraviolet rays. Finally, the UVLEDs 63*g* and 63*h* of the area B4 are positioned in a position in which the band recorded from the second discharge area A2-*b* can be cured by irradiating ultraviolet rays.

The controller 7 controls a printing operation of the inkjet recording apparatus 1 as shown in FIG. 2. In other words, in the controller 7, a processing unit (not shown) including a CPU controls the Y bar 3, the carriage 4, the inkjet heads 5, the ultraviolet irradiators 6 according to a program recorded in a memory device such as a ROM.

[Matte Image Mode]

Figure 10:
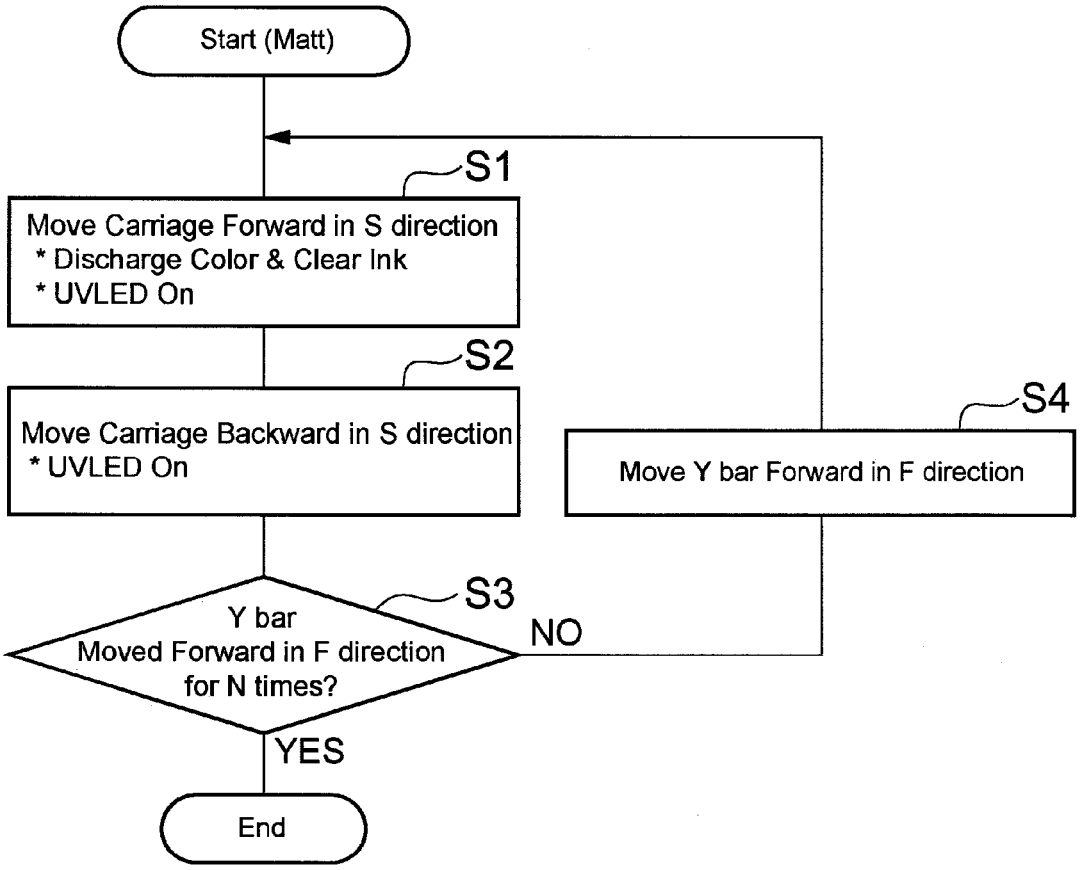
FIG. 10 is a flow chart of a printing process method in matt image mode.
Figure 11:
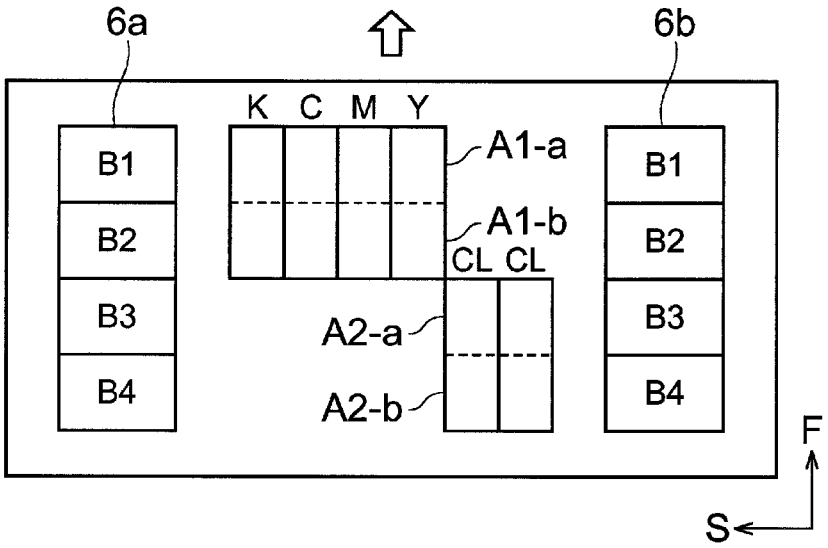
FIG. 11 is a conceptual diagram showing an example of operation of the carriage in matt image mode.

Referring to FIGS. 10 and 11, a printing process method for the matte image mode will be now described. FIG. 10 is a flow chart of the printing process method in the matte image mode. FIG. 11 is a conceptual diagram showing an operation of the carriage 4 in the matte image mode. As shown in FIG. 11, the Y bar 3 moves in the sub-scanning direction (F). In the matte image mode, ultraviolet-curable ink is discharged only when the carriage 4 moves forward in the main scanning direction (S) and no ink is discharged when the carriage 4 moves backward in the main scanning direction (S).

In the matte image mode, the medium (M) is first placed on the flat bed 2 and the Y bar 3 is located on a backward region (print starting position) in the sub-scanning direction (F) of a recording area of the medium (M).

As shown in FIG. 11, in a first scan, the first discharge area A1-*a* discharges color ink droplets and simultaneously the UVLEDs 63*a* and 63*b* positioned in the area B1 of the ultraviolet irradiator 6*b* are turned on when the carriage 4 moves forward in the main scanning direction (S) (step S1). Also, the UVLED 63 irradiating ultraviolet rays on the band recorded in the step S1 is turned on when the carriage 4 moves backward in the main scanning direction (S) (step S2). The UVLEDs 63 of at least one of the ultraviolet irradiators 6*a* and 6*b* may be turned on when the carriage 4 moves backward in the main scanning direction (S). Then, a first path record is made by the color ink discharged from the first discharge area A1-*a* and this color ink is cured in a particle shape by irradiating ultraviolet rays after being deposited on the medium (M).

When the back-and-forth motion of the carriage 4 in the main scanning direction (S) is completed, whether the Y bar 3 has moved in the sub-scanning direction (F) for a predetermined number of times is determined (step S3). In the matte image mode, a plurality of divided bands of printing data are recorded while the Y bar 3 sequentially moves in the sub-scanning direction (F). Recording each band is completed in four scans because two path record is made on the band by color ink in the first two scans and two path record is made on the band by clear ink in the next two scans. Thus, it is determined in the step S3 that the Y bar 3 has moved in the sub-scanning direction (F) for the predetermined number of times after the fourth scan and the predetermined number of times is calculated by adding a number of the plurality of the divided bands and three.

Since this scan is the first scan, it is determined that the Y bar 3 has not moved in the sub-scanning direction (F) for the predetermined number of times (step S3: No). Then, the step S1 is repeated after moving the Y bar 3 by one band (path width) in the sub-scanning direction (F) (step S4). Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the second scan, when the carriage 4 moves forward in the main scanning direction (S), color ink droplets are discharged from the first discharge area A1-*a* and the UVLEDs 63*a* and 63*b* positioned in the area B1 of the ultraviolet irradiator 6*b* are turned on. Furthermore, color ink droplets are discharged from the first discharge area A1-*b* and the UVLEDs 63*c* and 63*d* positioned in the area B2 of the ultraviolet irradiator 6*b* are turned on (step S1). When the carriage 4 moves backward in the main scanning direction (S), the UVLEDs 63 irradiating ultraviolet rays on the band recorded in the step S1 is turned on (step S2). However, the UVLEDs 63 of at least one of the ultraviolet irradiators 6*a* and 6*b* may be turned on when the carriage 4 moves backward in the main scanning direction (S). Then, the second path record is made by the color ink discharged from the first discharge area A1-*b* on the band on which the first path record is made by the color ink discharged from the first discharge area A1-*a* during the first scan. The color ink is cured in a particle shape by irradiating ultraviolet rays after being deposited on the medium (M). Now, the image recording by color ink on the band is completed. In the second scan, the first path record is made by the color ink discharged from the first discharge area A1-*a* (similar to first scan).

After the back-and-forth motion of the carriage 4 moving in the main scanning direction (S) is completed, the Y bar 3 is moved by one band (path width) in the sub-scanning direction (F) (step S4) and the step S1 is repeated because this scan is the second scan (step S3: No). Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the third scan, when the carriage 4 moves forward in the main scanning direction (S), color ink droplets are discharged from the first discharge areas A1-*a* and A1-*b* and the UVLEDs 63*a*-63*d* positioned in the areas B1 and B2 of the ultraviolet irradiator 6*b* are turned on. Furthermore, the second discharge area A2-*a* discharges clear ink droplets and the UVLEDs 63*e* and 63*f* positioned in the area B3 of the ultraviolet irradiator 6*b* are turned on (step S1). When the carriage 4 moves backward in the main scanning direction (S), the UVLEDs 63 irradiating ultraviolet rays on the band recorded in the step S1 is turned on (step S2). However, when the carriage 4 moves backward in the main scanning direction (S), the UVLEDs 63 of at least one of the ultraviolet irradiators 6*a* and 6*b* can be turned on. Then, the third path record is made by the clear ink discharged from the second discharge area A2-*a* on the band on which the second path record is made by the color ink discharged from the first discharge area A1-*b* during the second scan. This clear ink is cured in a particle shape by irradiating ultraviolet rays after being deposited on the medium (M). Thus, a first layer of coating is placed on the images of the medium (M) by the clear ink. In the third scan, the first path record is made by the color ink discharged from the first discharge area A1-*a* (similar to first scan). The second path record is made by the color ink discharged from the first discharge area A1-*b* (similar to second scan).

After the back-and-forth motion of the carriage 4 moving in the main scanning direction (S) is completed, the Y bar 3 is moved by one band (path width) in the sub-scanning direction (F) (step S4) and the step S1 is repeated because this scan is the third scan (step S3: No). Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the fourth scan, when the carriage 4 moves forward in the main scanning direction (S), the first discharge areas A1-*a* and A1-*b* discharge color ink droplets and the UVLEDs 63*a*-63*d* positioned in the areas B1 and B2 of the ultraviolet irradiator 6*b* are turned on. The second discharge area A2-*a* discharges clear ink droplets and the UVLEDs 63*e* and 63*f* positioned in the area B3 of the ultraviolet irradiator 6*b* are turned on. Furthermore, the second discharge area A2-*b* discharges clear ink droplets and simultaneously the UVLEDs 63*g* and 63*h* positioned in the area B4 of the ultraviolet irradiator 6*b* are turned on (step S1). When the carriage 4 moves backward in the main scanning direction (S), the UVLEDs 63 irradiating ultraviolet rays on the band recorded in the step S1 is turned on (step S2). However, when the carriage 4 moves backward in the main scanning direction (S), the UVLEDs 63 of at least one of the ultraviolet irradiators 6*a* and 6*b* can be turned on. Then, the fourth path record is made by the clear ink discharged from the second discharge area A2-*b* on the band on which the third path record is made by the clear ink discharged from the second discharge area A2-*a* during the previous scan. This clear ink is cured in a particle shape by irradiating ultraviolet rays after being deposited on the medium (M). Thus, a second layer of coating is placed on the images of the medium (M) by the clear ink and all the recordings for the band (discharging ultraviolet-curable ink, curing ultraviolet-curable ink by ultraviolet irradiator) are completed. In this fourth scan, the first path record is made by the color ink discharged from the first discharge area A1-*a* (similar to first scan). The second path record is made by the color ink discharged from the first discharge area A1-*b* (similar to second scan), and the third path record is made by the clear ink discharged from the second discharge area A2-*a* (similar to third scan).

After the back-and-forth motion of the carriage 4 moving in the main scanning direction (S) is completed, whether the Y bar 3 has moved in the sub-scanning direction (F) for the predetermined number of times is determined because this scan is the fourth scan (step S3).

If the Y bar 3 has not moved in the sub-scanning direction for the predetermined number of times (step 3: No), the Y bar 3 is moved by one band (path width) in the sub-scanning direction (F) (step S4) and the step S1 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F). The steps S1 to S3 are repeated until it is determined in the step S3 that the Y bar 3 has moved in the sub-scanning direction (F) for the predetermined number of times.

However, if it is determined that the Y bar 3 has moved in the sub-scanning direction (F) for the predetermined number of times (step S3: Yes), the printing process in the matte image mode is completed.

Since the clear ink having an uneven surface is recorded as an upper layer on the image recorded on the medium (M), the visibility of the image is enhanced and the matte image can be recorded.

[Gloss Image Mode]

Figure 12:
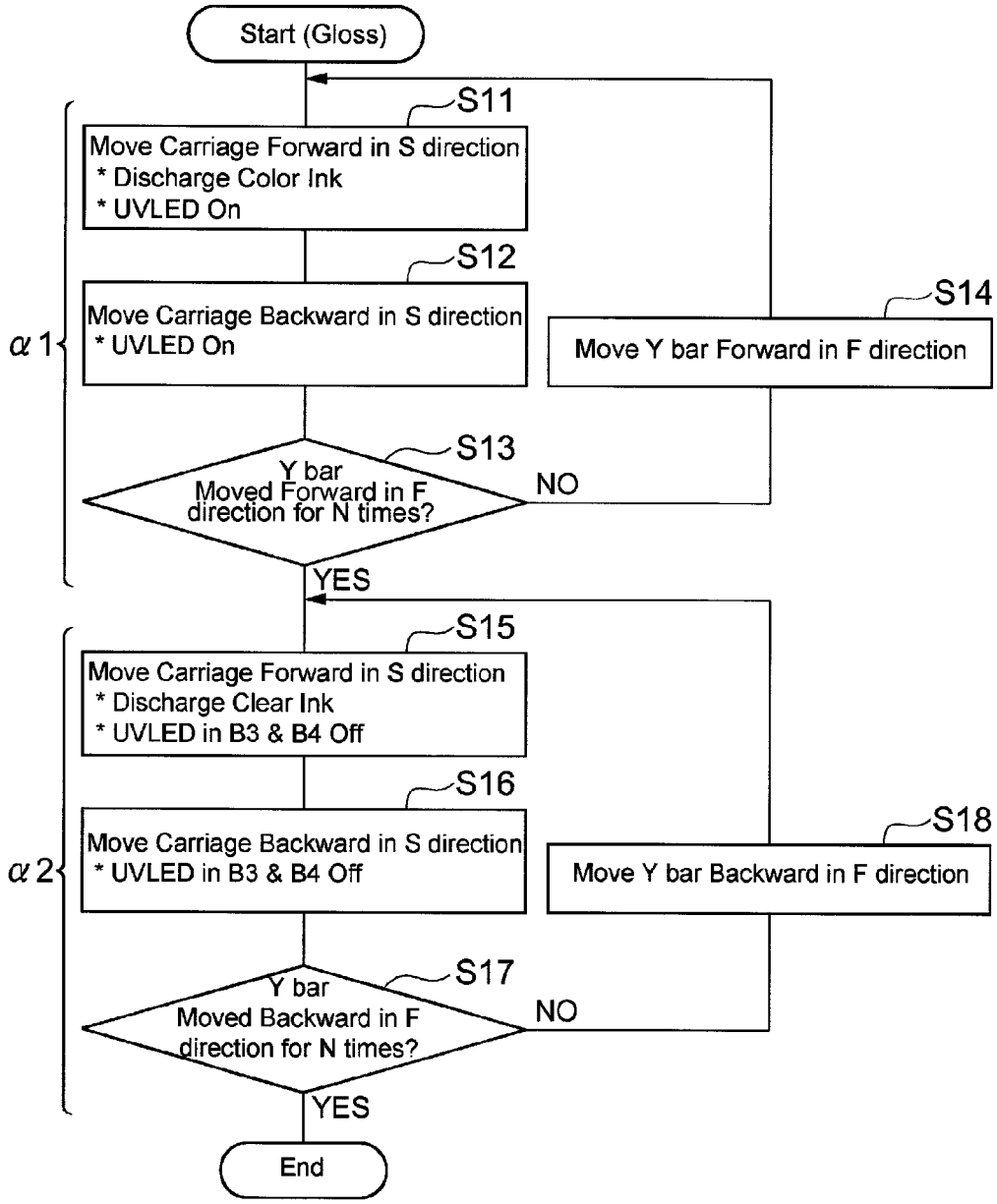
FIG. 12 is a flow chart of a printing process method in gloss image mode.
Figure 13:
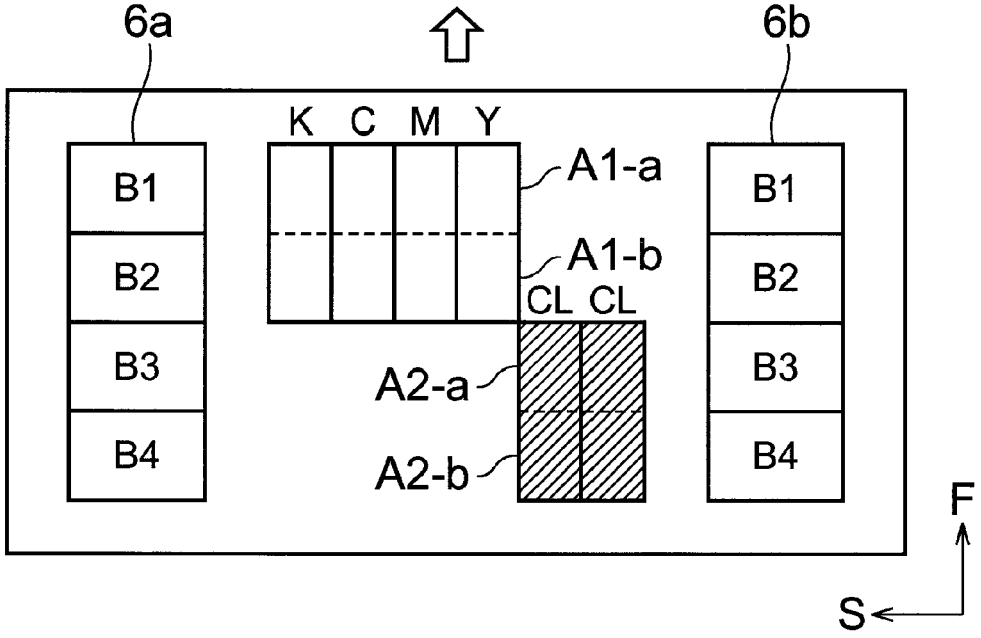
FIG. 13(A) and FIG. 13(B) are conceptual diagrams showing examples of operation of the carriage in gloss image mode.
Figure 13:
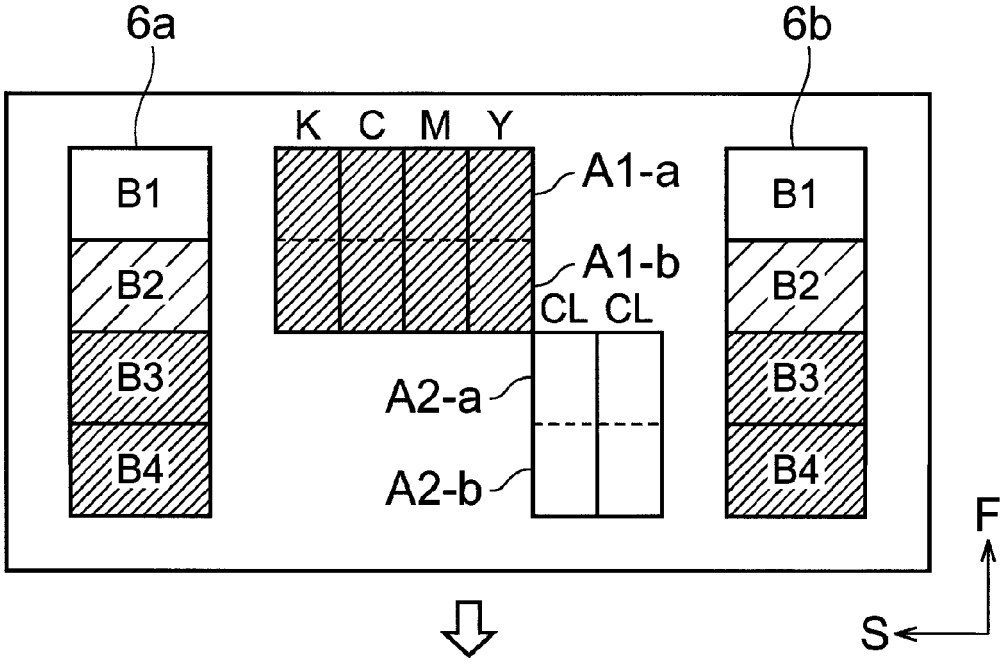

Referring to FIGS. 12 and 13, a printing process method in the gloss image mode will be now described. FIG. 12 is a flow chart of the printing process method in gloss image mode. FIGS. 13 (A) and (B) illustrate conceptual diagrams of an operation of the carriage 4 in the gloss image mode. In FIG. 13, the Y bar 3 moves in the sub-scanning direction (F). In other words, FIG. 13 (A) illustrates that the Y bar 3 moves forward in the sub-scanning direction (F) and FIG. 13 (B) illustrates that the Y bar 3 moves backward in the sub-scanning direction (F). In the gloss image mode, ultraviolet-curable ink is discharged only when the carriage 4 moves forward in the main scanning direction (S) and the ultraviolet-curable ink is not discharged when the carriage 4 moves backward in the direction of the main scanning direction (S).

As shown in FIGS. 12 and 13, in the gloss image mode, an image is recorded in color ink by sequentially moving the Y bar 3 in the sub-scanning direction (F) in the steps S11 to S14, and the image is coated with clear ink by sequentially moving the Y bar 3 backward in the sub-scanning direction (F) in the steps S15 to S18. In other words, in the color image mode, the image is recorded in color ink when the Y bar 3 moves forward in the sub-scanning direction (F), and the image is coated with clear ink when the Y bar 3 moves backward in the sub-scanning direction (F). Thus, the steps S11 to S14 are referred to as an image recording process (α1) and an example of an operation of the carriage 4 in this image recording process is shown in FIG. 13(A). Also, the steps S15 to S18 are referred to as a coating process (α2) and an example of an operation of the carriage 4 in this coating process is shown in FIG. 13(B).

The printing process method of the gloss image mode will now be described in detail.

First, the medium (M) is placed on the flat bed 2 and the Y bar 3 is positioned in the backward region (print starting position) in the sub-scanning direction (F) in a recording area of the medium (M). The image recording process (α1) is made by sequentially moving the Y bar 3 in the sub-scanning direction (F).

As shown in FIG. 13(A), in the first scan of the image recording process (α1), the first discharge area A1-*a* discharges color ink droplets and the UVLEDs 63*a* and 63*b* positioned in the area B1 of the ultraviolet irradiator 6*b* are turned on when the carriage 4 moves forward in the main scanning direction (S) (step S11). Also, the UVLEDs 63 irradiating ultraviolet rays to the recorded band in the step S1 are turned on when the carriage 4 moves backward in the main scanning direction (S) (step S12). However, when the carriage 4 moves backward in the main scanning direction (S), the UVLEDs 63 corresponding to at least one of the ultraviolet irradiators 6*a* and 6*b* can be turned on. Then, the first path record is made by the color ink discharged from the first discharge area A1-*a* and this color ink is cured in a particle shape by irradiating ultraviolet rays after being deposited on the medium (M).

After the back-and-forth motion of the carriage 4 in the main scanning direction (S) is completed, it is determined whether the Y bar 3 has moved in the sub-scanning direction (F) for a predetermined number of times (step S13). A plurality of divided bands for printing data are recorded while the Y bar 3 sequentially moves in the sub-scanning direction (F). Two path color ink recordation and irradiation are made in the first two scans and two path irradiation is made to complete four scan (four path) recordation for each band. Thus, it is determined that the Y bar 3 has moved in the sub-scanning direction (F) for the predetermined number of times in the step S13 after the fourth scan and the predetermined number of times is calculated by adding a number of the divided printing data and three.

Since this scan is the first scan of the image recording process (α1), it is determined that the Y bar 3 has not moved in the sub-scanning direction (F) for the predetermined number of times (step S13: No). Then, the step S11 is repeated after moving the Y bar by one band (path width) in the sub-scanning direction (F) (step S14). Since the carriage 4 mounted on the Y bar 3 is moved by one band in the sub-scanning direction (F), the inkjet heads 5 and the ultraviolet irradiators 6 correspond to the next path line, and a recording position with respect to the medium (M) moves forward in the sub-scanning direction (F).

In the second scan of the image recording process (α1), when the carriage 4 moves forward in the main scanning direction (S), the first discharge area A1-*a* discharges color ink droplets and the UVLEDs 63*a* and 63*b* positioned in the area B1 of the ultraviolet irradiator 6*b* are turned on. Furthermore, the first discharge area A1-*b* discharges color ink droplets and the UVLEDs 63*c* and 63*d* positioned in the area B2 of the ultraviolet irradiator 6*b* are turned on (step S11). When the carriage 4 moves backward in the main scanning direction (S), the UVLEDs 63 irradiating ultraviolet rays on the band recorded in the step S11 are turned on (step S12). However, when the carriage 4 moves backward in the main scanning direction (S), the UVLEDs 63 corresponding to at least one of the ultraviolet irradiators 6*a* and 6*b* is turned on. Then, the second path record is made by the color ink discharged from the first discharge area A1-*b* on the band on which the first path record is made by the color ink discharged from the first discharge area A1-*a* during the previous scan. The color ink is cured in a particle shape by irradiating ultraviolet rays after being deposited on the medium (M). Now, the image recording on the band by the color ink is completed. In the second scan, the first path record is made by the color ink discharged from the first discharge area A1-*a* (similar to the first scan).

The Y bar 3 is moved by one band (path width) in the sub-scanning direction (F) (step S14) and the step S11 is repeated because this scan is the second scan of the image recording process (α1) (step S13: No). Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the third scan of the image recording process (α1), when the carriage 4 moves forward in the main scanning direction (S), the first discharge areas A1-*a* and A1-*b* discharge color ink droplets and the UVLEDs 63*a* to 63*d* positioned in the areas B1 and B2 of the ultraviolet irradiator 6*b* are turned on. Furthermore, the UVLEDs 63*e* and 63*f* positioned in the area B3 are turned on (step S11). When the carriage 4 moves backward in the main scanning direction (S), the UVLEDs 63 irradiating ultraviolet rays on the band recorded in the step S11 are turned on (step S12). The color ink recorded on the band is further cured because the third path is made by irradiating from the UVLEDs 63*e* and 63*f* positioned in the area B3 on the band on which the second path is made by the color ink discharged from the first discharge area A1-*b* during the previous scan. In the third scan, the first path record is made by the color ink discharged from the first discharge area A1-*a* (similar to first scan) and the second path is made by the color ink discharged from the first discharge area A1-*b* (similar to second scan).

Since this scan is the third scan of the image recording process (α1), it is determined that the Y bar 3 has not moved for a predetermined number (m) of times (step S13: No). The Y bar 3 is moved by one band (path width) in the sub-scanning direction (F) and the step 11 is repeated (step S13: No). Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the fourth scan of the image recording process (α1), when the carriage 4 moves forward in the main scanning direction (S), the first discharge areas A1-*a* and A1-*b* discharge color ink droplets and the UVLEDs 63*a*-63*d* positioned in the areas B1 and B2 of the ultraviolet irradiator 6*b* are turned on. The UVLEDs 63*e* and 63*f* positioned in the area B3 of the ultraviolet irradiator 6*b* are turned on. Furthermore, the UVLEDs 63*g* and 63*h* positioned in the area B4 of the ultraviolet irradiator 6*b* are turned on (step S11). When the carriage 4 moves backward in the main scanning direction (S), the UVLEDs 63 irradiating ultraviolet rays on the band recorded in the step 11 and the UVLED 63*e* to 63*h* positioned in the areas B3 and B4 are turned on (step S12). The color ink recorded on the band is further cured because the band irradiated by the UVLEDs 63*e* and 63*f* positioned in the area B3 in the previous scan is irradiated from the UVLEDs 63*g* and 63*h* positioned in the area B4 correspond to the fourth path. In this fourth scan, the first path record is made by color ink discharged from the first discharge area A1-*a* (similar to first scan), the second path record is made by the color ink discharged from the first discharge area A1-*b* (similar to second scan), and the band on which the second path is made is irradiated from the UVLEDs 63*e* and 63*f* positioned in the area B4 (similar to third scan).

After the back-and-forth motion of the carriage 4 moving in the main scanning direction (S) is completed, whether the Y bar 3 has moved in the sub-scanning direction (F) for the predetermined number of times is determined because this scan is the fourth scan of the image recording process (α1) (step S13).

If the Y bar 3 has not moved in the sub-scanning direction (F) for the predetermined number of times (step S13: No), the Y bar 3 is moved by one band (path width) in the sub-scanning direction (F) (step S14) and the step S11 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F). The steps S11 to S13 are repeated until it is determined in the step S13 that the Y bar 3 has moved for the predetermined number of times.

Here, a method of recording the final band by the image recording process (α1) will be now described, when the final scan is the (m)th scan.

In the (m−2)th scan which is two scans before the final scan, when the carriage 4 moves forward in the main scanning direction (S), the color ink discharged from the first discharge area A1-*a* stops discharging color ink. The first discharge area A1-*b* discharges color ink droplets, the UVLEDs 63*c* and 63*d* positioned in the area B2 of the ultraviolet irradiator 6*b*, the UVLEDs 63*e*-63*h* positioned in the areas B3 and B4 are turned off (step S11). When the carriage 4 moves backward in the main scanning direction (S), the UVLEDs 63 irradiating ultraviolet rays to the carriage 4 and the UVLEDs 63*e*-63*h* positioned in the areas B3 and B4 are turned on (step S12). Then, the second path record is made by the color ink discharged from the first discharge area A1-*a* on the final band on which the first path record is made by the color ink discharged from the first discharge area A1-*a* during the previous scan. The UVLEDs 63*e* and 63*f* positioned in the area B3 irradiates ultraviolet rays on the band on which the second path is made by the color ink discharged from the first discharge area A1-*b*. The UVLEDs 63*g*-63*h* positioned in the area B4 irradiates ultraviolet rays on the band irradiated by ultraviolet rays from the UVLEDs 63*e* and 63*f* positioned in the area B3.

In the (m−1)th scan which is one scan before the final scan, when the carriage 4 moves forward in the main scanning direction (S), the first discharge areas A1-*a* and A1-*b* stop discharging the color ink and the UVLEDs 63*e*-63*h* positioned in the areas B3 and B4 are turned on (step S11). When the carriage 4 moves backward in the main scanning direction (S), the UVLEDs 63*e*-63*h* positioned in the areas B3 and B4 are turned on (step S12). Then, the UVLEDs 63*e* and 63*f* positioned in the area B3 irradiate ultraviolet rays on the final band on which the second path is made by the color ink discharged from the first discharge area A1-*b* during the previous scan. The UVLEDs 63*g* and 63*h* positioned in the area B4 irradiate ultraviolet rays on the band irradiated by ultraviolet rays from the UVLEDs 63*e* and 63*f* positioned in the area B3 during the previous scan.

In the final (m)th scan, when the carriage 4 moves forward in the main scanning direction (S), the first discharge areas A1-*a* and A1-*b* stop discharging the color ink. The UVLEDs 63*e* and 63*f* positioned in the area B3 are turned off and the UVLEDs 63*g* and 63*h* are turned on (step S11). When the carriage 4 moves backward in the main scanning direction (S), only the UVLEDs 63*g* and 63*h* positioned in the area B4 are turned on (step S12). Then, the UVLEDs 63*g* and 63*h* positioned in the area B4 irradiate ultraviolet rays on the final band irradiated by ultraviolet rays from the UVLEDs 63*e* and 63*f* positioned in the area B3 during the previous scan.

Thus, the image recording process (α1) is terminated while the second discharge area A2-*b* is positioned on the path line of the final band.

Meanwhile, if it is determined that the Y bar 3 has moved forward in the sub-scanning direction (F) for the predetermined number of times (step S13: Yes), the coating process (α2) is made by sequentially moving the Y bar 3 backward in the sub-scanning direction (F).

As shown in FIG. 13(B), in the first scan of the coating process (α2), when the carriage 4 moves forward in the main scanning direction (S), the second discharge area A2-*b* discharges clear ink droplets and the UVLEDs 63*g* and 63*h* positioned in the ultraviolet irradiators 6*a* and 6*b* of the area B4 are turned off (step S15). Also, when the carriage 4 moves backward in the main scanning direction (S), the UVLEDs 63*g* and 63*h* positioned on the band recorded by the clear ink in the step S15 are turned off (step S16). The second discharge area A2-*b* is positioned on the path line of the final band in the image recording process (α1). Thus, the fifth path record is made by the clear ink discharged from the second discharge area A2-*b* on the final band of the image recording process (α1) positioned in the most forward region in the sub-scanning direction (F). Since the UVLEDs 63*g* and 63*h* positioned in the area B4 irradiating ultraviolet rays on the band recorded by clear ink discharged from the second discharge area A2-*b* are turned off, clear ink discharged on the medium (M) during the fifth path is not cured but spread out. Then, its thickness becomes thinner and the embossed surface becomes flattened. Meanwhile, in the first scan, the UVLEDs 63*a*-63*d* positioned in the areas B1 and B2 can be turned on or off.

When the back-and-forth motion of the carriage 4 moving in the main scanning direction (S) is completed, whether the Y bar 3 has moved in the sub-scanning direction (F) for a predetermined number of times is determined (step S17). In the coating process (α2), a plurality of a divided band for printing data is recorded while the Y bar 3 sequentially moves in the sub-scanning direction (F). Recording each band is completed in four scans (four paths) because the band is recorded by clear ink in the first two scans and the recorded clear ink in each band is irradiated by ultraviolet rays in the next two scans. Thus, it is determined that the Y bar 3 has moved backward in the sub-scanning direction (F) for the predetermined number of times in the step S17 after the fourth scan and the predetermined number of times is calculated by adding a number of the divided printing data and three.

It is determined that the Y bar 3 has not moved backward in the sub-scanning direction (F) for the predetermined number of times (step S17: No) because this scan is the first scan of the coating process (α2). The step S15 is repeated after moving the Y bar 3 backward by one band (path width) in the sub-scanning direction (F) (step S18). Since the Y bar 3 mounted to the carriage 4 is moved backward by one band in the sub-scanning direction (F), the inkjet heads 5 and the ultraviolet irradiators 6 correspond to the next path line and a recording position with respect to the medium (M) moves backward in the sub-scanning direction (F).

In the second scan of the coating process (α2), when the carriage 4 moves forward in the main scanning direction (S), the second discharge area A2-*b* discharges clear ink droplets and the UVLEDs 63*g* and 63*h* positioned in the area B4 of the ultraviolet irradiators 6*b* and 6*b* are turned off. Furthermore, the second discharge area A2-*a* discharges clear ink droplets and the UVLEDs 63*e* and 63*f* positioned in the area B3 of the ultraviolet irradiators 6*a* and 6*b* are turned off (step S15). When the carriage 4 moves backward in the main scanning direction (S), the UVLEDs 63*e*-63*h* aligned on the band recorded in clear ink in the step S15 are turned off (step S16). The sixth path record is made by the clear ink discharged from the second discharge area A2-*a* on the band on which the fifth path record is made by the clear ink discharged from the second discharge area A2-*b* during the first scan. Since the UVLEDs 63*e* and 63*f* positioned in the area B3 irradiating ultraviolet rays on the band recorded by the clear ink discharged from the second discharge area A2-*a* are turned off, the clear ink discharged on the medium (M) in the sixth path is not cured but gradually spread out with the clear ink in the fifth path. Its thickness becomes thinner and the embossed surface becomes flattened. Also, in this second scan, the fifth path record is made by the clear ink discharged from the second discharge area A2-*b* (similar to first scan). Meanwhile, the UVLEDs 63*a*-63*d* positioned in the areas B1 and B2 can be turned on or off.

After the back-and-forth motion of the carriage 4 in the main scanning direction (S) is completed, the Y bar 3 is moved backward by one band (path width) in the sub-scanning direction (step S17: No) and the step S15 is repeated because this scan is the second scan of the coating process (α2) (step 18). Since the carriage 4 mounted on the Y bar 3 is moved backward by one band in the sub-scanning direction (F), the inkjet heads 5 and the ultraviolet irradiators 6 correspond to the next path line and a recording position with respect to the medium (M) moves backward in the sub-scanning direction (F).

In the third scan of the coating process (α2), when the carriage 4 moves forward in the main scanning direction (S), the second discharge areas A2-*a* and A2-*b* discharge clear ink droplets, the UVLEDs 63*e* to 63*h* positioned in the ultraviolet irradiators 6*a* and 6*b* of the areas B3 and B4 are turned off, the UVLEDs 63*c* and 63*d* positioned in the area B2 is turned on (step S15). When the carriage 4 moves backward in the main scanning direction (S), the UVLEDs 63*c* and 63*d* positioned in the area B2 are turned on (step S16). At least one of the ultraviolet irradiators 6*a* and 6*b* turns on the UVLEDs 63*c* and 63*d*. The seventh path is made by ultraviolet rays irradiated from the UVLEDs 63*c* and 63*d* positioned in the area B2 on the band on which the sixth path record is made by the clear ink discharged from the second discharge area A2-*a* during the second scan. Curing starts when the clear ink from the fifth and sixth paths becomes sufficiently flatten. In the third scan, the fifth path record is made by the clear ink discharged from the second discharge area A2-*b* (similar to first scan) and the sixth path record is made by the clear ink discharged from the second discharge area A2-*a* (similar to second scan).

After the back-and-forth motion of the carriage 4 in the main scanning direction (S) is completed, the Y bar 3 is moved backward by one band (path width) in the sub-scanning direction (step S18) and the step S15 is repeated, since this scan is the third scan of the coating process (α2) (step S17: No). Since the carriage 4 mounted on the Y bar 3 is moved backward by one band in the sub-scanning direction (F), the inkjet heads 5 and the ultraviolet irradiators 6 correspond to the next path line and a recording position with respect to the medium (M) moves backward in the sub-scanning direction (F).

In the fourth scan of the coating process (α2), when the carriage 4 moves forward in the main scanning direction (S), the second discharge areas A2-*a* and A2-*b* discharge clear ink droplets, the UVLEDs 63*e*-63*h* positioned in the areas B3 and B4 of the ultraviolet irradiators 6*a* and 6*b* are turned off, and the UVLEDs 63*a* and 63*b* positioned in the area B1 are turned on (step S15). Also, when the carriage moves backward in the main scanning direction (S), the UVLEDs 63*a*-63*d* positioned in the areas B1 and B2 are turned on (step S16). At least one of the ultraviolet irradiators 6*a* and 6*b* turns on the UVLEDs 63*a*-63*d*. The eighth path is made by ultraviolet rays irradiated from the UVLEDs 63*a* and 63*b* positioned in the area B1 on the band irradiated by ultraviolet rays from the UVLEDs 63*c* and 63*d* during the third scan and curing clear ink is sufficiently enhanced. In the fourth scan, the fifth path record is made by the clear ink discharged from the second discharge area A2-*b* (similar to first scan), and the sixth path record is made by the clear ink discharged from the second discharge ink A2-*a* (similar to second scan). The band on which the sixth path record is made in the previous scan is irradiated by ultraviolet rays.

When the back-and-forth motion of the carriage 4 in the main scanning direction (S) is terminated, since this scan is the fourth scan of the coating process (α2), it is determined whether the Y bar 3 moves backward in the sub-main scanning direction (F) for the predetermined number of times (step S17).

If it is determined that the Y bar 3 has not moved backward in the sub-scanning direction (F) for the predetermined number of times (step S17: No), the Y bar 3 moves backward in the sub-scanning direction (F) by one band (path width) (step S18) and the step S15 is repeated. Since the carriage 4 mounted on the Y bar 3 is moved backward by one band in the sub-scanning direction (F), the inkjet heads 5 and the ultraviolet irradiators 6 correspond to the next path line and a recording position with respect to the medium (M) moves backward in the sub-scanning direction (F). The steps of S15 to S17 are repeated until it is determined in the step S17 that the Y bar 3 has moved backward in the sub-scanning direction (F) for the predetermined number of times.

If it is determined that the Y bar 3 has moved backward in the sub-scanning direction (F) for the predetermined number of times (step S17: Yes), the printing process in the gloss image mode is terminated.

Since the smoothened clear ink is recorded as an upper layer on the image recorded on the medium (M), the image visibility is enhanced and the image becomes glossy.

Figure 14:
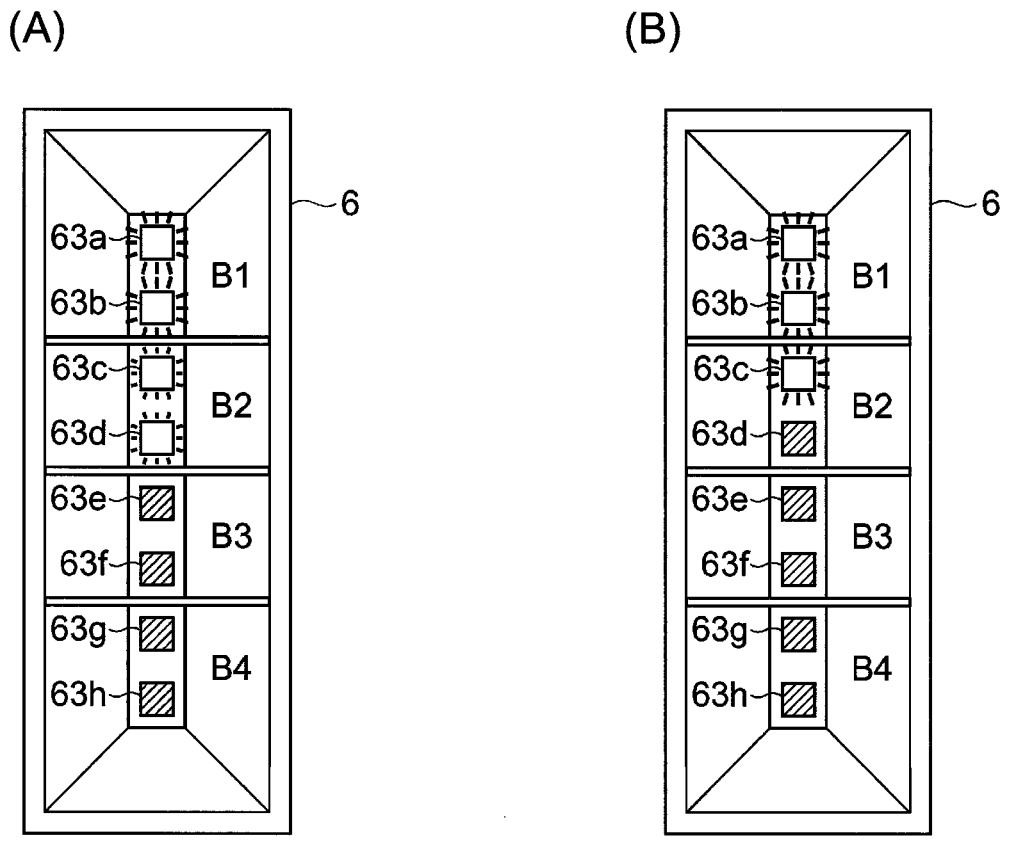
FIG. 14(A) and FIG. 14(B) show examples of light control of UVLEDs.

In the steps S15 and S16, it is preferred that the amount of the ultraviolet irradiation emitted from the UVLEDs 63*c* and 63*d* positioned in the area B2 is less than that of the UVLEDs 63*a* and 63*b* positioned in the area B1. The amount of ultraviolet irradiation can be controlled by individual light control of the UVLEDs 63. As shown in FIG. 14(A), the amount of the ultraviolet irradiation of the UVLEDs 63*c* and 63*d* is reduced by lowering the current flowing through the UVLEDs 63*c* and 63*d*. As shown in FIG. 14(B), the UVLED 63*c* can be turned on like the UVLEDs 63*a* and 63*b* and the UVLED 63*d* can be turned off. Meanwhile, for highly curable ink, only UVLEDs 63*a* and 63*b* can be turned on.

Since the amount of initial ultraviolet irradiation is reduced and the amount of the ultraviolet irradiation can be gradually increased, bending caused by curing clear ink quickly can be prevented and the clear ink can be surely cured by turning on the UVLEDs 63. Since the speed of curing the clear ink directly deposited on the color ink slows down, the adherence of the color ink and the clear ink improves.

Figure 15:
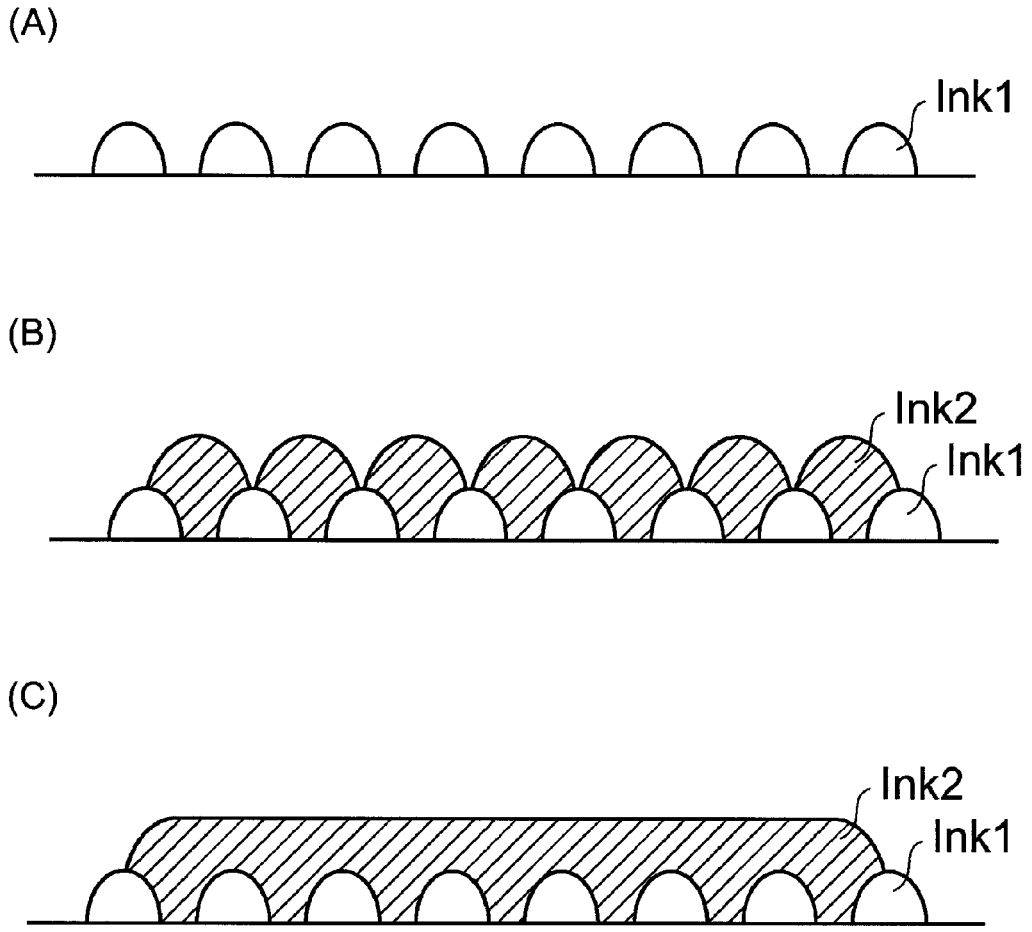
FIG. 15(A) to FIG. 15(C) illustrate states of ink droplets deposited on a medium.

Referring to FIGS. 15(A) to (C), a curing status of the clear ink will now be described. FIGS. 15(A) to (C) illustrate ink droplets deposited on the medium (M). In the image recording process (α1), since color ink (Ink 1) is cured in a particle shape after being deposited on the medium (M), the color ink (ink 1) is cured in a particle shape as shown in FIG. 15(A). In the coating process (α2), since clear ink (Ink 2) is not cured after being deposited on the medium (M), the clear ink (ink 2) is smeared into the cured color ink (ink 1), and is combined with the neighboring clear ink (ink 2) droplets. The clear ink (ink 2) smoothens the uneven surface because it spreads out and its thickness is reduced. If a lower layer of the color ink is smoothened, the speed of smoothening the clear ink slows down because the motion of the clear ink on the upper layer is not active. Thus, the speed of smoothening the clear ink increases by curing the color ink on the lower layer in a particle shape because the motion of the upper layer of the clear ink becomes active. Since the clear ink (ink 2) is cured after it is sufficiently smoothened, the gloss quality of the images can be obtained.

[Thick Image Mode]

Figure 16:
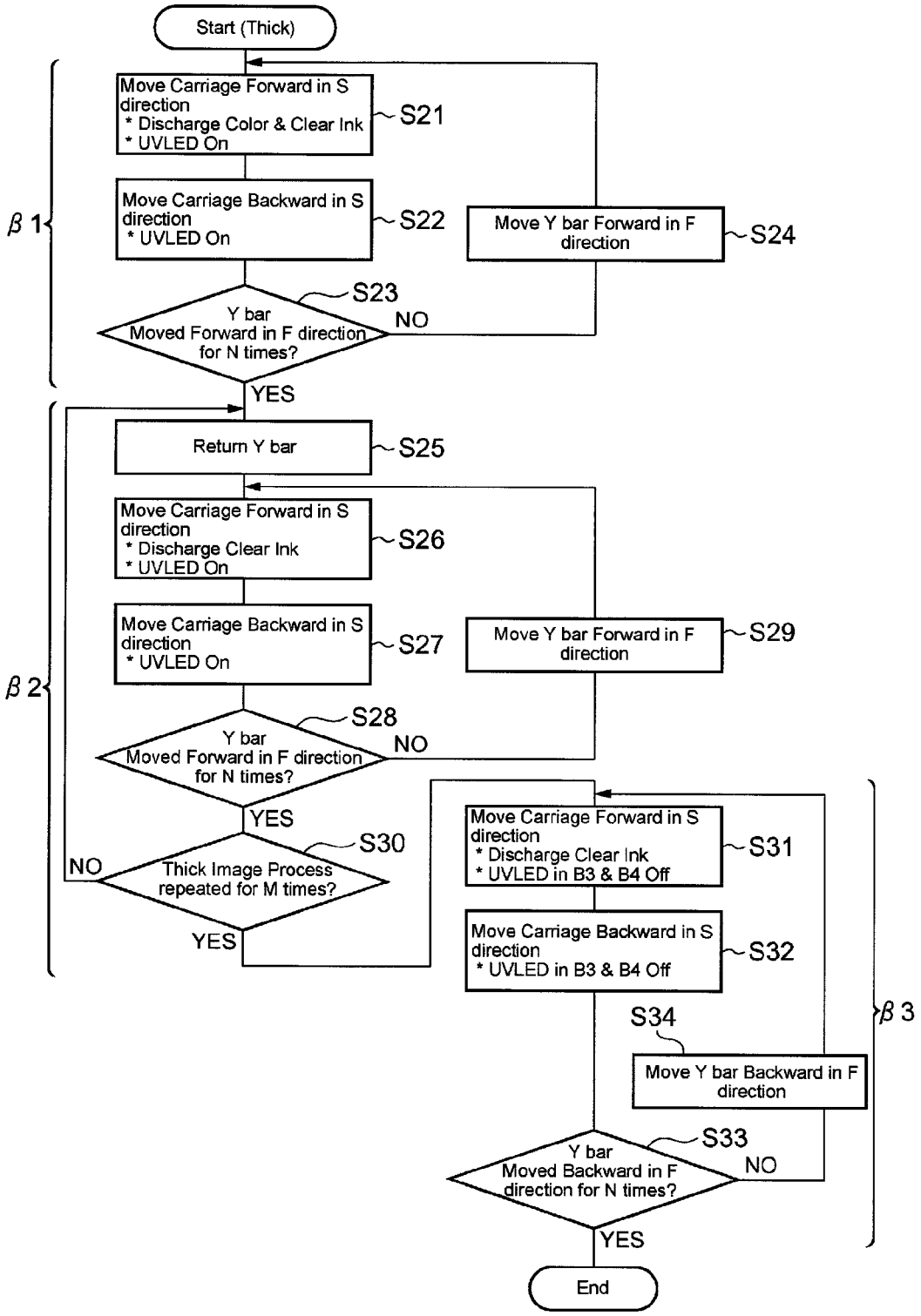
FIG. 16 is a flow chart of a printing process method in thick image mode.
Figure 17:
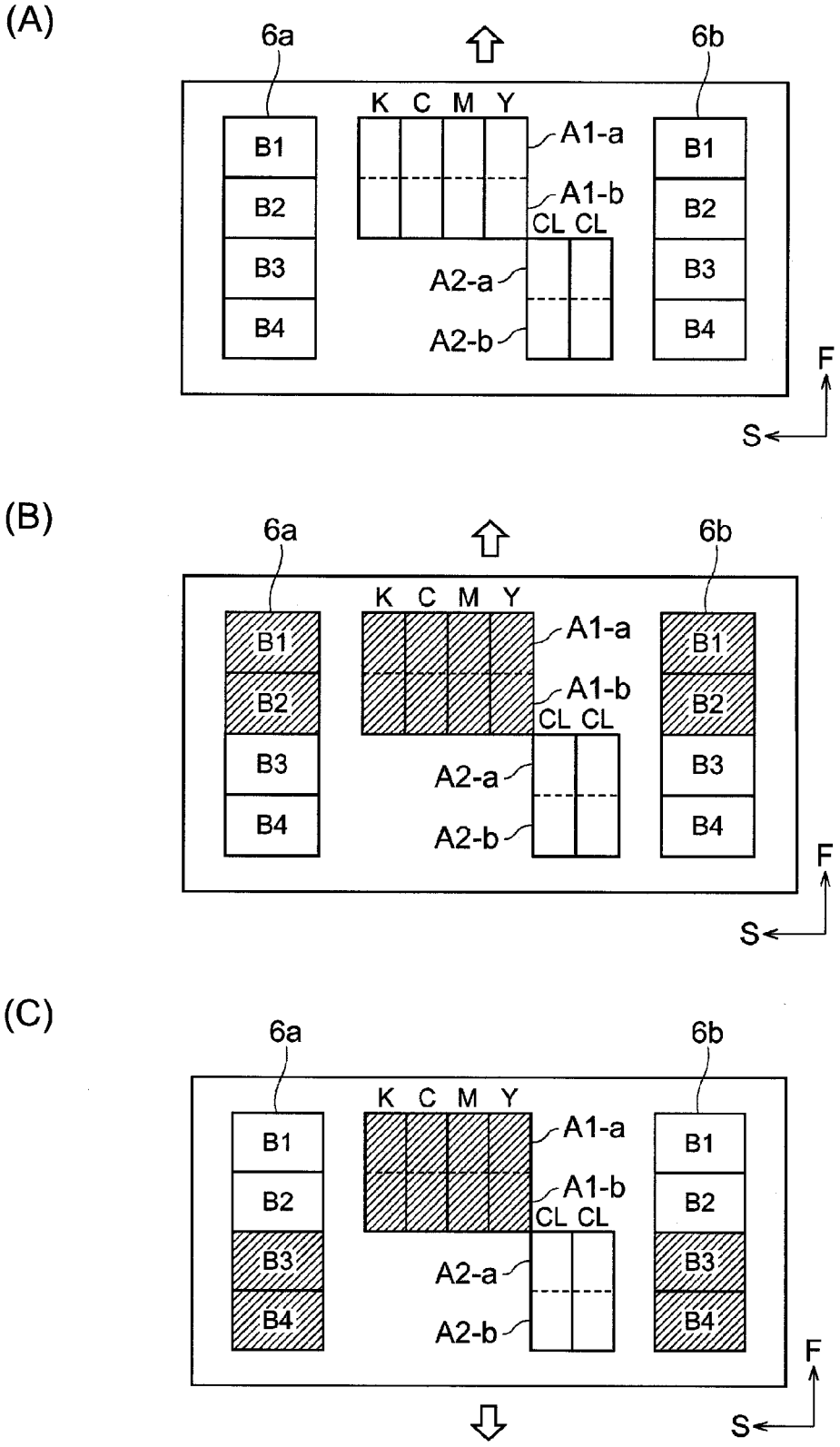
FIG. 17(A) to FIG. 17(C) are conceptual diagrams showing examples of operation of the carriage in thick image mode.

Referring to FIGS. 16 and 17(A) to (C), a printing process method in the thick image mode will now be described. FIG. 16 is a flow chart of the printing process method in the thick image mode. FIGS. 17(A) to (C) illustrates a conceptual diagram of an operation of the carriage 4 in the thick image mode. In FIGS. 17(A) to (C), the Y bar 3 moves in the sub-scanning direction (F). In other words, the Y bar 3 moves in the sub-scanning direction (F) in FIGS. 17(A) and (B) but the Y bar 3 moves backward in the sub-scanning direction (F) in FIG. 17(C). The ultraviolet-curable ink is discharged only when the carriage 4 moves in the main scanning direction (S) in the thick image mode. The ultraviolet curable ink is not discharged when the carriage 4 moves backward in the main scanning direction (S).

As shown in FIGS. 16 and 17(A) to (C), in the thick image mode, the image recording by color ink and image coating by clear ink are made by sequentially moving the Y bar 3 in the sub-scanning direction (F) in the steps S21 to S24. The image is thickened by clear ink by sequentially moving the Y bar 3 in the sub-scanning direction (F) in the steps S25 to S30. The gloss process by clear ink is made by moving the Y bar 3 backward in the sub-scanning direction (F) in the steps S31 to S34. Thus, the steps S21 to S24 are referred to as an image recording coating process (β1) and FIG. 17(A) shows an operation of the carriage 4 in the image recording coating process (β1). The steps S25 to S30 are referred to as a thick image process (β2) and FIG. 17(B) shows an operation of the carriage 4 in the thick image process (β2). Finally, the steps S31 to S34 are referred to as a gloss process (β3) and FIG. 17(C) shows an operation of the carriage 4 in the gloss process (β3).

The printing process method in the thick image mode will now be described in detail.

The medium (M) is placed on the flat bed 2, the Y bar 3 is located in the forward region (print starting position) in the sub-scanning direction (F) of a recording area of the medium (M), and the image recording coating process (β1) is moved by sequentially moving the Y bar 3 in the sub-scanning direction (F).

As shown in FIG. 17(A), in the first scan of the image recording coating process (β1), when the carriage 4 moves forward in the main scanning direction (S), the first discharge area A1-*a* discharges the color ink droplets and simultaneously the UVLEDs 63*a* and 63*b* positioned in the ultraviolet irradiator 6*b* of the area B1 are turned on (step S21). When the carriage 4 moves backward in the main scanning direction (S), the UVLEDs 63 irradiating ultraviolet rays on the band recorded in the step S21 are turned on (step S22). When the carriage 4 moves backward in the main scanning direction (S), the UVLEDs 63 of at least one of the ultraviolet irradiators 6*a* and 6*b* can be turned on. Then, a first path record is made by the color ink discharged from the first discharge area A1-*a* and the color ink is cured in a particle shape after being deposited on the medium (M).

After the back-and-forth motion of the carriage 4 in the main scanning direction (S) is completed, it is determined whether the Y bar 3 has moved in the sub-scanning direction (F) for a predetermined number of times (step S23). A plurality of divided bands for printing data are recorded by sequentially moving the Y bar 3 forward in the sub-scanning direction (F) in the image recording coating process (β1). The recordation for each band is completed in four scans because two path recordation by color ink is made on the band in the first two scans and two path recordation by clear ink is made on the band in the next two scans. Thus, it is determined that the Y bar 3 has moved in the sub-scanning direction (F) for the predetermined number of times after the fourth scan in the step S23 and the predetermined number of times is calculated by adding the number of the divided printing data and three.

Since this scan is the first scan of the image recording coating process (β1), it is determined that the Y bar 3 has not moved in the sub-scanning direction for the predetermined number of times (step S23: No). The Y bar 3 is moved by one band (path width) in the sub-scanning direction (F) (step S24) and the step S21 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the second scan of the image recording coating process (β1), when the carriage 4 moves forward in the main scanning direction (S), the first discharge area A1-*a* discharges color ink droplets and simultaneously the UVLEDs 63*a* and 63*b* positioned in the ultraviolet irradiator 6*b* of the area B1 are turned on. Furthermore, the first discharge area A1-*b* discharges color ink droplets and simultaneously the UVLEDs 63*c* and 63*d* positioned in the ultraviolet irradiator 6*b* of the area B2 are turned on (step S21). When the carriage 4 moves backward in the main scanning direction (S), the UVLEDs 63 irradiating ultraviolet rays on the band recorded in the step S21 are turned on (step S22). When the carriage 4 moves backward in the main scanning direction (S), the UVLEDs of at least one of the ultraviolet irradiators 6*a* and 6*b* are turned on. Then, the second path record is made by the color ink discharged from the first discharge area A1-*b* on the band on which the first path is made by the color ink discharged from the first discharge area A1-*a*. This color ink is cured in a particle shape by irradiating ultraviolet rays after being deposited on the medium (M). Thus, all the recordings by color ink (discharging by color ink, curing color ink by ultraviolet irradiation) on the band are terminated. In the second scan, the first path record is made by the color ink discharged from the first discharge area A1-*a* (similar to first scan).

After the back-and-forth motion of the carriage 4 in the main scanning direction (S) is completed, since this scan is the second scan of the image recording coating process (β1) (step S23: No), the Y bar 3 is moved by one band (path width) in the sub-scanning direction (F) (step S24) and the step S21 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the third scan of the image recording coating process (β1), when the carriage 4 moves in the main scanning direction (S), the first discharge areas A1-*a* and A1-*b* discharge color ink droplets and simultaneously the UVLEDs 63*a*-63*d* positioned in the ultraviolet irradiator 6*b* of the areas B1 and B2 are turned on. Furthermore, the second discharge area A2-*a* discharges clear ink droplets and simultaneously the UVLEDs 63*e* and 63*f* positioned in the ultraviolet irradiator 6*b* of the area B3 are turned on (step S21). When the carriage 4 moves backward in the main scanning direction (S), the UVLEDs 63 irradiating ultraviolet rays on the band recorded in the step S21 are turned on (step S22). When the carriage 4 moves backward in the main scanning direction (S), the UVLEDs 63 of at least one of the ultraviolet irradiators 6*a* and 6*b* are turned on. Then, the third path record is made by the color ink discharged from the second discharge area A2-*a* on the band on which the second path record is made by the color ink discharged from the first discharge area A1-*b* during the second scan. This clear ink is cured in a particle shape by irradiating ultraviolet rays after being deposited on the medium (M). Thus, a first layer of coating by clear ink on the images is generated. In the third scan, the first path record is made by the color ink discharged from the first discharge area A1-*a* (similar to first scan) and the second path record is made by the color ink discharged from the first discharge area A1-*b* (similar to second scan).

After the back-and-forth motion of the carriage 4 in the main scanning direction (S) is completed, since this scan is the third scan of the image recording coating process (β1) (step S23: No), the Y bar 3 is moved by one band (path width) in the sub-scanning direction (F) (step S24) and the step S21 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the fourth scan of the image recording coating process (β1), when the carriage 4 moves in the main scanning direction (S), the first discharge areas A1-*a* and A1-*b* discharge color ink droplets and simultaneously the UVLEDs 63*a*-63*d* positioned in the ultraviolet irradiator 6*b* of the areas B1 and B2 are turned on. The second discharge area A2-*a* discharges clear ink droplets and simultaneously the UVLEDs 63*e* and 63*f* positioned in the ultraviolet irradiator 6*b* of the area B3 are turned on. Furthermore, the second discharge area A2-*b* discharges clear ink droplets and simultaneously the UVLEDs 63*g* and 63*h* positioned in the ultraviolet irradiator 6*b* of the area B4 are turned on (step S21). When the carriage 4 moves backward in the main scanning direction (S), the UVLEDs 63 irradiating ultraviolet rays on the band recorded in the step S21 are turned on (step S22). When the carriage 4 moves backward in the main scanning direction (S), the UVLEDs 63 of at least one of the ultraviolet irradiators 6*a* and 6*b* can be turned on. The fourth path record is made by the clear ink discharged from the second discharge area A2-*b* on the band on which the third path record is made by the clear ink discharged from the second discharge area A2-*a* during the previous scan. This clear ink is cured in a particle shape by irradiating ultraviolet rays after being deposited on the medium (M). Thus, the second layer of coating by clear ink on the images is generated. In the fourth scan, the first path record is made by the color ink discharged from the first discharge area A1-*a* (similar to first scan). The second path record is made by the color ink discharged from the first discharge area A1-*b* (similar to second scan). The third path record is made by the clear ink discharged from the second discharge area A2-*a* (similar to third scan).

After the back-and-forth motion of the carriage 4 in the main scanning direction (S) is completed, since this scan is the fourth scan of the image recording coating process (β1), it is determined whether the Y bar 3 has moved in the sub-scanning direction (F) for the predetermined number of times (step S23).

If it is determined that the Y bar 3 has not moved in the sub-scanning direction (F) for the predetermined number of times (step S23: No), the Y bar 3 is moved forward in the sub-scanning direction (F) by one band (path width) (step S24) and the step S21 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F). The steps S21 to S23 are repeated until it is determined in the step S23 that the Y bar 3 has moved in the sub-scanning direction (F) for the predetermined number of times.

If it is determined that the Y bar 3 has moved in the sub-scanning direction (F) for the predetermined number of times (step S23: Yes), the Y bar 3 returns to the original position (print starting position of step S21) (step S25) by moving backward in the sub-scanning direction (F) and the thick image process (β2) begins by sequentially moving the Y bar 3 in the sub-scanning direction (F).

As shown in FIG. 17(B), in the first scan of the thick image process (β2), no ink is discharged and no ultraviolet rays are irradiated. The carriage 4 moves forward and backward in the main scanning direction (S) (steps S26 and S27). The fifth path idling is made on the band located in the most backward region in the sub-scanning direction (F). The idling means the back-and-forth motion of the carriage 4 without discharging ink and without ultraviolet ray irradiation.

After the back-and-forth motion of the carriage 4 in the main scanning direction (S) is completed, it is determined whether the Y bar 3 has moved in the sub-scanning direction (F) for a predetermined number of times (step S28). A plurality of divided bands for printing data are recorded by sequentially moving the Y bar 3 forward in the sub-scanning direction (F) in the thick image process (β2). The recordation of each band is completed in four scans (four paths) because the two path idling is made on the band in the first two scans and the two path recordation is made by the clear ink on the band in the next two scans. Thus, it is determined that the Y bar 3 has moved in the sub-scanning direction (F) for a predetermined number of times after the fourth scan in the step S28 and the predetermined number of times is calculated by adding the number of the divided printing data and three.

Since this scan is the first scan of the thick image process (β2), it is determined that the Y bar 3 has not moved in the sub-scanning direction (F) for the predetermined number of times (step S28; No). The Y bar 3 is moved by one band (path width) in the sub-scanning direction (F) (step S29) and the step S26 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the second scan of the thick image process (β2), no ink is discharged and no ultraviolet rays are irradiated. The carriage 4 moves back and forth in the main scanning direction (S) (step S26 and S27). The sixth path idling is made on the band positioned in the most backward region in the sub-scanning direction (F). The fifth path idling is made on a neighboring band positioned in the forward region in the sub-scanning direction (F).

After the back-and-forth motion of the carriage 4 in the main scanning direction (S) is completed, since this scan is the second scan of the thick image process (β2), it is determined that the Y bar 3 has not moved in the sub-scanning direction (F) for the predetermined number of times (step S28: No). The Y bar is moved by one band (path width) in the sub-scanning direction (F) (step S29) and the step S26 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the third scan of the thick image process (β2), when the carriage 4 moves forward in the main scanning direction (S), the second discharge area A2-*a* discharges clear ink droplets and simultaneously the UVLEDs 63*e* and 63*f* positioned in the ultraviolet irradiator 6*b* of the areas B3 are turned on (step S25). When the carriage 4 moves backward in the main scanning direction (S), the UVLEDs 63 irradiating ultraviolet rays on the band recorded in the step S25 are turned on (step S26). When the carriage 4 moves backward in the main scanning direction (S), the UVLEDs 63 of at least one of the ultraviolet irradiators 6*a* and 6*b* are turned on. Then, the seventh path record is made by the clear ink discharged from the second discharge area A2-*a* on the band on the most backward position in the sub-scanning direction (F). This clear ink is cured in a particle shape by irradiating ultraviolet rays after being deposited on the medium (M). Thus, the images recorded in the image recording coating process (β1) are thickened by one layer.

After the back-and-forth motion of the carriage 4 in the main scanning direction (S) is completed, since this scan is the third scan of the thick image process (β2), it is determined that the Y bar 3 has not moved in the sub-scanning direction (F) for the predetermined number of times (step S28: No). The Y bar is moved by one band (path width) in the sub-scanning direction (F) (step S29) and the step S26 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F).

In the fourth scan of the thick image process (β2), when the carriage 4 moves forward in the main scanning direction (S), the second discharge area A2-*a* discharges clear ink droplets and simultaneously the UVLEDs 63*e* and 63*f* positioned in the ultraviolet irradiator 6*b* of the area B3 are turned on.

Furthermore, the second discharge area A2-*b* discharges clear ink droplets and simultaneously the UVLEDs 63*g* and 63*h* positioned in the ultraviolet irradiator 6*b* of the area B4 are turned on (step S25). When the carriage 4 moves backward in the main scanning direction (S), the UVLEDs 63 irradiating ultraviolet rays on the band recorded in the step S25 are turned on (step S26). When the carriage 4 moves backward in the main scanning direction (S), the UVLEDs 63 of at least one of the ultraviolet irradiators 6*a* and 6*b* are turned on. Then, the eighth path record is made by the clear ink discharged from the second discharge area A2-*b* on the band on which the seventh path is made by the clear ink discharged from the second discharge area A2-*a* during the previous scan. This clear ink is cured in a particle shape by irradiating ultraviolet rays after being deposited on the medium (M). In this fourth scan, the seventh path record is made by the clear ink discharged from the second discharge area A2-*a* (similar to third scan).

After the back-and-forth motion of the carriage 4 in the main scanning direction (S) is completed, since this scan is the fourth scan of the thick image process (β2), it is determined whether the Y bar 3 has moved in the sub-scanning direction (F) for the predetermined number of times (step S28).

If it is determined that the Y bar 3 has not moved in the sub-scanning direction (F) for the predetermined number of times (step S28: No), the Y bar is moved by one band (path width) in the sub-scanning direction (F) (step S29) and the step S26 is repeated. Since the carriage 4 mounted on the Y bar 3 is moved by one band in the sub-scanning direction (F), the inkjet heads 5 and the ultraviolet irradiators 6 correspond to the next path line and a recording position with respect to the medium (M) moves forward in the sub-scanning direction (F). The steps of S26 to S28 are repeated until it is determined in the step S28 that the Y bar 3 has moved in the sub-scanning direction (F) for the predetermined number of times.

Here, if the final scan is the (m)th scan, a method of recording the final band by the image recording process (α1) will now be described.

In the final (m)th scan, when the carriage 4 moves forward in the main scanning direction (S), the second discharge area A2-*a* discharges clear ink droplets and simultaneously the UVLEDs 63*e* and 63*f* positioned in the area B3 are turned off. Furthermore, the second discharge area A2-*b* discharges clear ink droplets and simultaneously the UVLEDs 63*g* and 63*h* positioned in the ultraviolet irradiator 6*b* of the area B4 are turned on (step S26). When the carriage 4 moves backward in the main scanning direction (S), only the UVLEDs 63*g* and 63*h* positioned in the area B4 are turned on (step S27). Then, the eighth path record is made by the clear ink discharged from the second discharge area A2-*b* on the final band is recorded by the clear ink discharged from the second discharge area A2-*a* and irradiated ultraviolet rays by the UVLEDs 63*g* and 63*h* positioned in the area B4 during the previous scan.

Thus, a single image recording process (α1) in the thick image process (β2) is completed while the second discharge area A2-*b* is positioned on the final band path line.

If it is determined that the Y bar 3 has moved in the sub-scanning direction (F) for the predetermined number of times (step S28: Yes), it is determined whether the thick image process (β2) has been made for a predetermined number of times (step S30). Here, in order to thicken the clear ink into a predetermined thickness, the thick image process (β2) is repeated as many times as required. The number of the times required is specified by a predetermined value or a value determined in printing data. Thus, if the number of this thick image process (β2) has not reached the predetermined number in the step S30, it is determined that the thick image process (β2) has not been performed for the predetermined number of times. If the number of the thick image process (β2) has reached the predetermined number, it is determined that the thick image process (β2) has been performed for the predetermined number.

If it is determined that the thick image process (β2) has not been performed for the predetermined number of times (step S30: No), the steps S25 to S30 are repeated.

If it is determined that the thick image process (β2) has been performed for the predetermined number of times (step S30: Yes), the gloss process (β3) is made by sequentially moving the Y bar 3 backward in the sub-scanning direction (F).

As shown in FIG. 17(C), in the first scan of the gloss process (β3), when the carriage 4 moves forward in the main scanning direction (S), the second discharge area A2-*b* discharges clear ink droplets and simultaneously the UVLEDs 63*g* and 63*h* positioned in the ultraviolet irradiators 6*a* and 6*b* of the area B4 are turned off (step S31). When the carriage 4 moves backward in the main scanning direction (S), the UVLEDs 63*g* and 63*h* positioned in the step S31 are turned off (step S32). Then, the second discharge area A2-*b* is positioned on the final band path line of the thick image process (β2). Thus, if the number of all the paths in the thick image mode is n, (n−3)th path record is made by the clear ink discharged from the second discharge A2-*b* on the final band of the thick image process (β2) located on the most forward region in the sub-scanning direction (F). Then, since the UVLEDs 63*g* and 63*h* positioned in the area B4 which irradiates ultraviolet rays on the band on which the second discharge area A2-*b* discharges the clear ink are turned off, the clear ink discharged on the medium (M) in the (n−3)th path is not cured. Its thickness becomes thinner and the uneven surface is smoothened. In the first scan, the UVLEDs 63*a*-63*d* positioned in the areas B1 and B2 can be turned on or off.

After the back-and-forth motion of the carriage 4 in the main scanning direction (S) is completed, it is determined whether the Y bar 3 has moved backward in the sub-scanning direction (F) for the predetermined number of times (step S33). A plurality of divided bands for printing data are recorded by sequentially moving the Y bar 3 backward in the sub-scanning direction (F) in the gloss process (β3). The recordation of each band is completed in four scans (four paths) because the two path recordation is made by the clear ink on the band in the first two scans and the two path irradiation is made on the recorded clear ink in the next two scans. Thus, it is determined that the Y bar 3 has moved backward in the sub-scanning direction (F) for the predetermined number of times after the fourth scan in the step S33 and the predetermined number in the gloss process (β3) is calculated by adding the number of the divided printing data and three.

Since this scan is the first scan of the gloss process (β3), it is determined that the Y bar 3 has not moved backward in the sub-scanning direction (F) for the predetermined number of times (step S33: No). The Y bar 3 is moved backward by one band (path width) in the sub-scanning direction (F) (step S34) and the step S31 is repeated. Since the carriage 4 mounted on the Y bar 3 is moved backward by one band in the sub-scanning direction (F), the inkjet heads 5 and the ultraviolet irradiators 6 correspond to the next path line and a recording position with respect to the medium (M) moves backward in the sub-scanning direction (F).

In the second scan of the gloss process (β3), when the carriage 4 moves forward in the main scanning direction (S), the second discharge area A2-*b* discharges clear ink droplets and simultaneously the UVLEDs 63*g* and 63*h* positioned in the ultraviolet irradiators 6*a* and 6*b* of the area B4 are turned off. Furthermore, the second discharge area A2-*a* discharges clear ink droplets and simultaneously the UVLEDs 63*e* and 63*f* positioned in the ultraviolet irradiators 6*a* and 6*b* of the area B3 are turned off (step S31). When the carriage 4 moves backward in the main scanning direction (S), the UVLEDs 63*e*-63*h* positioned on the band recorded by the clear ink in the step S31 are turned off (step S32). The (n−2)th path record is made by the clear ink discharged from the second discharge area (A2-*a*) on the band on which the (n−3)th path record is made by the clear ink discharged from the second discharge area (A2-*b*) during the first scan. Thus, the UVLEDs 63*e* and 63*f* are positioned in the area B3 to irradiate ultraviolet rays on the band to which the second discharge A2-*a* discharges the clear ink. Since such UVLEDs 63*e* and 63*f* are turned off, the clear ink discharged on the medium (M) in the (n−2)th path is not cured but its thickness with the clear ink in the (n−3)th path becomes thinner and the uneven surface is smoothened. In the second scan, (n−3)th path is made by the clear ink discharged from the second discharge area A2-*b* (similar to first scan). Meanwhile, in the second scan, the UVLEDs 63*a*-63*d* positioned in the areas B1 and B2 can be turned on or off.

After the back-and-forth motion of the carriage 4 in the main scanning direction (S) is completed, since this scan is the second scan of the gloss process (β3) (step S33: No), the Y bar 3 is moved backward by one band (path width) in the sub-scanning direction (F) (step S34) and the step S31 is repeated. Since the carriage 4 mounted on the Y bar 3 is moved backward by one band in the sub-scanning direction (F), the inkjet heads 5 and the ultraviolet irradiators 6 correspond to the next path line and a recording position with respect to the medium (M) moves backward in the sub-scanning direction (F).

In the third scan of the gloss process (β3), when the carriage 4 moves forward in the main scanning direction (S), the second discharge areas A2-*a* and A2-*b* discharge clear ink droplets and simultaneously the UVLEDs 63*e*-63*h* positioned in the ultraviolet irradiators 6*a* and 6*b* of the areas B3 and B4 are turned off. Furthermore, the UVLEDs 63*c* and 63*d* positioned in the area B2 are turned on (step S31). When the carriage 4 moves backward in the main scanning direction (S), the UVLEDs 63*c* and 63*d* positioned in the area B2 are turned on (step S32). The UVLEDs 63*c* and 63*d* of at least one of the ultraviolet irradiators 6*a* and 6*b* can be turned on. Then, (n−1)th path is made by the ultraviolet rays irradiated from the UVLEDs 63*c* and 63*d* of the area B2 on the band on which the (n−2)th path record is made by the clear ink discharged from the second discharge area A2-*a* during the second scan. The clear ink of the (n−3)th path and (n−2)th path is sufficiently smoothened and cured. In this third scan, the (n−3)th path record is made by the clear ink discharged from the second discharge area A2-*b* (similar to first scan) and the (n−2)th path record is made by the clear ink discharged from the second discharge area A2-*a* (similar to second scan).

After the back-and-forth motion of the carriage 4 in the main scanning direction (S) is completed, since this scan is the third scan of the gloss process (β3) (step S33: No), the Y bar 3 is moved backward by one band (path width) in the sub-scanning direction (F) (step S34) and the step S31 is repeated. Since the carriage 4 mounted on the Y bar 3 is moved backward by one band in the sub-scanning direction (F), the inkjet heads 5 and the ultraviolet irradiators 6 correspond to the next path line and a recording position with respect to the medium (M) moves backward in the sub-scanning direction (F).

In the fourth scan of the gloss process (β3), when the carriage 4 moves forward in the main scanning direction (S), the second discharge areas A2-*a* and A2-*b* discharge clear ink droplets and simultaneously the UVLEDs 63*e*-63*h* positioned in the ultraviolet irradiators 6*a* and 6*b* of the areas B3 and B4 are turned off. The UVLEDs 63*c* and 63*d* positioned in the area B2 are turned on. Furthermore, the UVLEDs 63*a* and 63*b* positioned in the area B1 are turned on (step S31). When the carriage 4 moves backward in the main scanning direction (S), the UVLEDs 63*a*-63*d* positioned in the areas B1 and B2 are turned on (step S32). The UVLEDs 63*a*-63*d* of at least one of the ultraviolet irradiators 6*a* and 6*b* can be turned on. Then, the final nth path is made by ultraviolet rays irradiated from the UVLEDs 63*a* and 63*b* on the band irradiated by ultraviolet rays from the UVLEDs 63*c* and 63*d* positioned in the area B2 during the third scan. The clear ink is sufficiently cured. In the fourth scan, the (n−3)th path record is made by the clear ink discharged from the second discharge area A2-*b* (similar to first scan). The (n−2)th path record is made by the clear ink discharged from the second discharge area A2-*a* (similar to second scan). The band on which the (n−2)th path is made is irradiated by ultraviolet rays (similar to third scan).

After the back-and-forth motion of the carriage 4 in the main scanning direction (S) is completed, since this scan is the fourth scan of the gloss process (β3), it is determined whether the Y bar 3 has moved backward in the sub-scanning direction (F) for the predetermined number of times (step S33).

If it is determined that the Y bar 3 has not moved backward in the sub-scanning direction (F) for the predetermined number of times (step S33: No), the Y bar 3 is moved backward by one band (path width) in the sub-scanning direction (F) (step S34), and the step S31 is repeated. Then since the carriage 4 has moved backward by one band in the sub-scanning direction (F), the inkjet heads 5 and the ultraviolet irradiators 6 correspond to the next path line and a recording position with respect to the medium (M) moves backward in the sub-scanning direction (F). The steps of S31 to S33 are repeated until it is determined in the step S33 that the Y bar 3 has moved backward in the sub-scanning direction (F) for the predetermined number of times.

However, if it is determined that the Y bar 3 has moved backward in the sub-scanning direction (F) for the predetermined number of times (step S33: Yes), the printing process in the gloss image mode is terminated.

Thus, since a layer of the clear ink on the upper layer of the image recorded on the medium (M) is laminated and the smoothened clear ink is recorded on the upper layer, the image visibility is enhanced, the layer of the clear ink is thickened, and the image can be glossy.

Meanwhile, it is preferred that, in the steps S31 and S32, the amount of ultraviolet rays emitted from the UVLEDs 63*c* and 63*d* positioned in the area B2 is less than that of ultraviolet rays emitted from the UVLEDs 63*a* and 63*b* positioned in the area B1 (similar to steps S15 and S16). In the thick image process (β2) prior to the gloss process (β3), the speed of smoothening the clear ink can increase because the upper layer of the clear ink becomes active by curing the particles of the lower layer of the clear ink.

According to the inkjet recording apparatus 1, the ultraviolet irradiation intensity can be altered in the sub-scanning direction (F) by turning on and off the UVLEDs 63 because a plurality of the UVLEDs 63 are arranged in the sub-scanning direction (F) and simultaneously the ultraviolet rays in the sub-scanning direction (F) are blocked by the partition walls 64. Thus, desired printing images such as matte, gloss, and thick images can be obtained by altering the ultraviolet irradiation intensity in the sub-scanning direction (F) by the plurality of the light sources and the partition walls 64.

Desired printing images can be obtained because the ultraviolet irradiation intensity for each band can be controlled by arranging the UVLEDs 63 and the partition walls 64 corresponding to each band.

The heat of ultraviolet rays can be suppressed by using the UVLEDs 63 in the ultraviolet irradiators 6. Since the UVLEDs 63 can be promptly turned on and off, energy can be saved by emitting the ultraviolet rays only when necessary.

The ultraviolet irradiation can be appropriately controlled in the sub-scanning direction (F) because the ultraviolet rays can be shielded in the sub-scanning direction (F) by the partition walls 64 extended in the main scanning direction (S).

The direction of the ultraviolet irradiation is broadened in the main scanning direction (S) because the concave portion 62 is provided on the bottom side of the ultraviolet irradiator 6 and the UVLEDs 63 are provided on the center of the bottom area of the concave portion 62. The small UVLEDs 63 can irradiate the ultraviolet rays for a longer period of time. Moreover, since the partition walls 64 are extended from the bottom of the concave portion 62 to the opening area, the ultraviolet rays irradiated from the UVLEDs 63 are prevented from being irradiated in the sub-scanning direction (F) over the partition walls 64.

Various image qualities can be obtained by only one inkjet recording apparatus 1 because the controller 7 turns on and off each of the UVLEDs 63.

All the ink droplets discharged from the ink nozzles can be cured by moving the carriage 4 back and forth in the main scanning direction (S) in a single scan because the ultraviolet irradiators 6 are positioned in the forward and backward regions of the first and second discharge areas A1 and A2 in the main scanning direction (S).

The embodiment of the present disclosure has been described above and the present disclosure is not only limited to the embodiments. For example, a number and positions of the UVLEDs 63 arranged in the ultraviolet irradiators 6, a number and positions of the partition walls 64 inserted in the ultraviolet irradiators 6, and the intensity distribution of the ultraviolet irradiation for controlling each UVLEDs 63 can be appropriately determined depending on image qualities.

Figure 18:
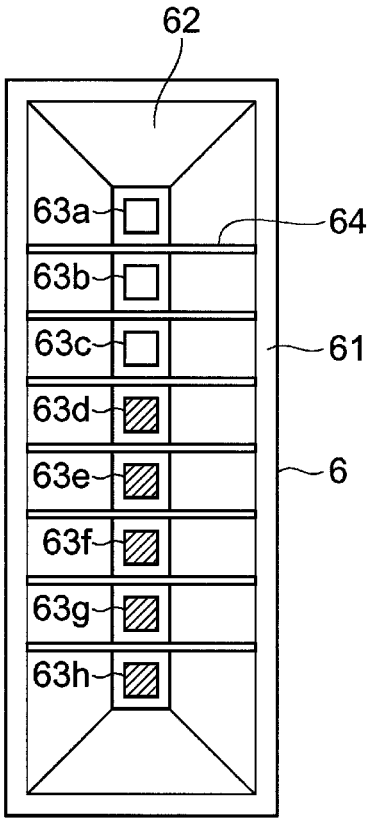
FIG. 18 illustrates an ultraviolet irradiator with 7 partition walls provided therein.

According to the embodiment, although three partition walls 64 are inserted in the ultraviolet irradiators 6, there can be any number of the partition walls 64. As shown in FIG. 18, seven partition walls 64 can be inserted. In such case, the amount of the ultraviolet rays from the UVLEDs 63 positioned in the area B2 can be effectively reduced by turning on the UVLEDs 63*a*-63*c* and turning off the UVLEDs 63*d*-63*h* in the coating process (α2) of the gloss image mode.

According to the embodiment of the present disclosure, although ink droplets are discharged only when the carriage 4 moves forward in the main scanning direction (S), the ink droplets can be discharged when the carriage 4 moves both forward and backward in the main scanning direction (S).

Figure 20:
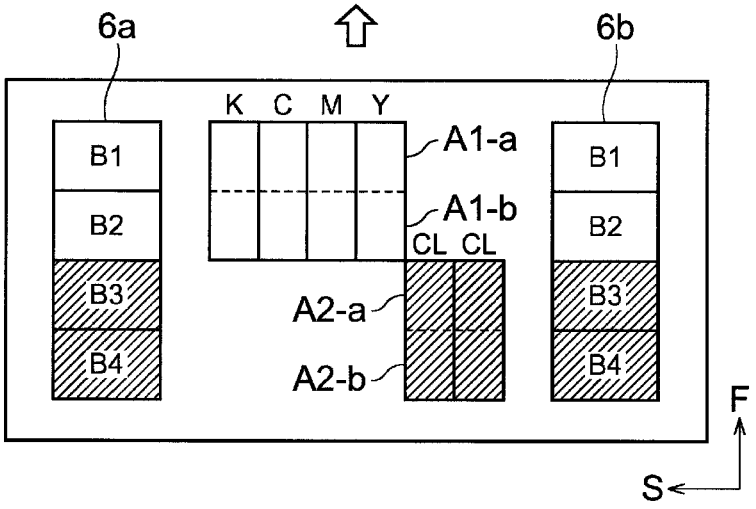
FIG. 20 shows an example of light control of UVLEDs in image recording process in gloss image mode.

According to the embodiment of the present disclosure, although all of the UVLEDs 63 are turned on in the image recording process (α1) of the gloss image mode, the UVLEDs 63 positioned in the areas B3 and B4 can be turned off to suppress over-curing color ink, as shown in FIG. 20. Thus, the adherence of color ink and clear ink can be improved by suppressing the over-curing color ink because the color ink is not irradiated by ultraviolet rays until the coating process (α2) after the ultraviolet rays are irradiated during the second path recordation.

According to the embodiment of the present disclosure, although the image recording coating process (β1), the thick image process (β2), and gloss process (β3) are explained for the thick image mode, the thick image process (β2) is not required. For example, the image recording coating process (β1) and gloss process (β3) can be made for the thick image mode.

According to the embodiment, the clear ink is recorded while the Y bar 3 moves forward in the sub-scanning direction (F) in the thick image process (β2) in the thick image mode. However, the clear ink can also be recorded while the Y bar 3 moves backward in the sub-scanning direction (F). In such case, the moving direction of the Y bar 3 in the sub-scanning direction (F) can be reversed when the thick image process (β2) is repeated.

Figure 19:
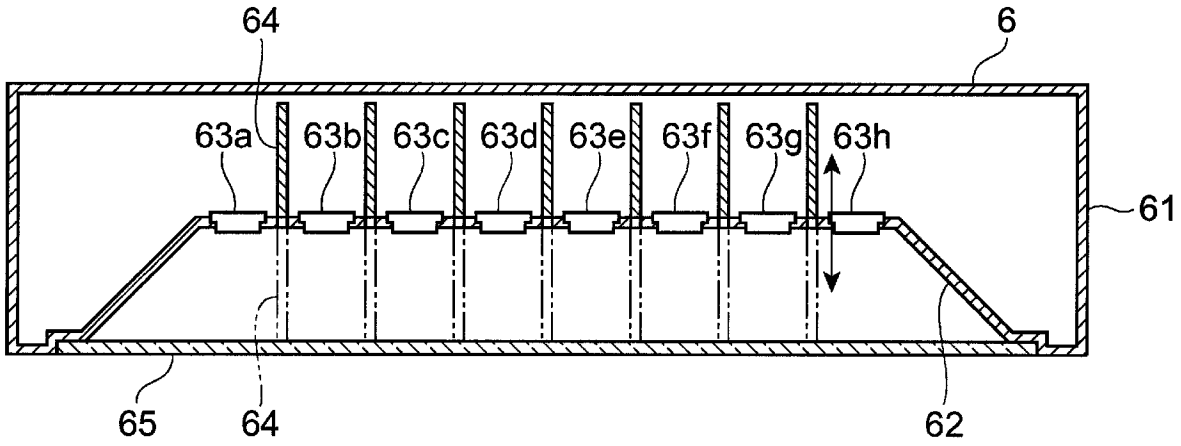
FIG. 19 is a cross-sectional view of an ultraviolet irradiator in a sub-scanning direction where partition walls are removably insertable from a main body to a concave portion.

According to the embodiment of the present disclosure, although inserting and removing the partition walls 64 in the ultraviolet irradiators 6 is not described in detail, the partition walls 64 can be inserted or removed from the opening area of the concave portion 62 after the cover 65 is taken off or the partition walls 64 can be inserted or removed through the main body 61 to the concave portion 62, as shown in FIG. 19. In such case, the insertion and removal of each partition wall 64 can be controlled by an actuator or a lead screw. Or, physically, each partition wall 64 can have a handle that extends out of the main body 61 for the insertion and removal.

According to the embodiment of the present disclosure, although the partition wall 64 has a trapezoidal shape, it can have any kind of shape as long as the ultraviolet rays are shielded.

According to the embodiment of the present disclosure, although the ultraviolet irradiators 6 are positioned in the forward and backward regions in the main scanning direction (S) with respect to the inkjet heads 5, the ultraviolet irradiator can be positioned in one of the forward and backward regions.

According to the embodiment of the present disclosure, although the ultraviolet irradiators 6*a* and 6*b* are identical, they do not need to be identical and can be different from each other as long as they are within the scope of the present disclosure.

According to the embodiment of the present disclosure, a band recorded by color ink and a band recorded by clear ink are offset in the sub-scanning direction (F) by specifying discharge areas for ink droplets from the ink nozzles 8 mounted in each inkjet head 5. However, a band recorded by color ink and a band recorded by clear ink can be offset in the sub-scanning direction (F) by physically offsetting the band recorded by color ink and the band recorded by clear ink in the sub-scanning direction (F).

According to the embodiment of the present disclosure, although the nozzle lines of the ink nozzles 8 for each band are arranged as a straight line in the main scanning direction (S), the nozzle lines of the ink nozzles 8 for one or a plurality of the bands can be offset in the main scanning direction (S) by arranging the inkjet heads 5 on a plurality of nozzle lines in the main scanning direction (S). Also, according to the embodiment, although the color ink nozzles 8 and the clear ink nozzles 8 are offset in the main scanning direction (S), these ink nozzles 8 can be arranged as a straight line in the sub-scanning direction (F). In that case, ink nozzles for color ink and ink nozzles for clear ink can be positioned in different inkjet heads or in the same inkjet heads.

According to the embodiment of the present disclosure, although the ULVEDs 63 are used for the light sources of the ultraviolet irradiators 6, any means such as UV lamps can be used as long as ultraviolet rays can be emitted.

According to the embodiment of the present disclosure, the inkjet heads 5 and the medium (M) are moved with respect to each other in the sub-scanning direction (F) while the Y bar 3 moves the inkjet heads 5. However, at least one of the inkjet heads 5 and the medium (M) or both can be moved. For example, a grid rolling type can be used to move the inkjet heads 5 and the medium (M) with respect to each other in the sub-scanning direction (F) by moving the medium (M).

What is claimed is:

1. An inkjet recording apparatus comprising:

a carriage moving back and forth in a main scanning direction;

ink discharging means mounted on the carriage and comprising a plurality of ink nozzles arranged in a sub-scanning direction for discharging ultraviolet-curable ink on a recording medium; and ultraviolet irradiating means mounted on the carriage for irradiating ultraviolet rays on the medium, wherein the carriage or the medium moves in the sub-scanning direction which is perpendicular to the main scanning direction, wherein the ultraviolet irradiating means comprises a plurality of light sources arranged in the sub-scanning direction for irradiating the ultraviolet rays, and a plurality of partition walls blocking ultraviolet irradiation of the light sources in the sub-scanning direction, wherein the plurality of ink nozzles comprises a plurality of path areas to record a plurality of bands, the plurality of light sources irradiate the ultraviolet rays on the plurality of bands, respectively, and each partition wall blocks ultraviolet irradiation of a light source on a band other than a corresponding band.

2. The inkjet recording apparatus of claim 1, wherein the light sources comprise a plurality of ultraviolet light emitting diodes (UVLEDs) arranged in the sub-scanning direction, and the partition walls are provided to form a plurality of shielded portions extended in the main scanning direction.

3. The inkjet recording apparatus of claim 1, wherein a concave portion is provided on a side of the ultraviolet irradiating means facing the recording medium, the light sources are provided on a bottom surface of the concave portion, and the partition walls are provided such that the shielded portions extends from the bottom surface to an opening area of the concave portion.

4. The inkjet recording apparatus of claim 1, wherein the partition walls are removably insertable into the ultraviolet irradiating means.

5. The inkjet recording apparatus of claim 1, further comprising a light controller turning on and off the light sources.

6. The inkjet recording apparatus of claim 1, wherein the ultraviolet irradiating means is provided in at least one of front and rear regions of the ink nozzles in the main scanning direction.

7. An inkjet recording apparatus comprising:

a carriage moving back and forth in a main scanning direction;

ink discharging means mounted on the carriage and comprising a plurality of ink nozzles arranged in a sub-scanning direction for discharging ultraviolet-curable ink on a recording medium; and ultraviolet irradiating means mounted on the carriage for irradiating ultraviolet rays on the medium, wherein the carriage or the medium moves in the sub-scanning direction which is perpendicular to the main scanning direction, wherein the ultraviolet irradiating means comprises a plurality of light sources arranged in the sub-scanning direction for irradiating the ultraviolet rays, and a plurality of partition walls blocking ultraviolet irradiation of the light sources in the sub-scanning direction, wherein the partition walls are removably insertable into the ultraviolet irradiating means.

8. The inkjet recording apparatus of claim 7, wherein the light sources comprise a plurality of ultraviolet light emitting diodes (UVLEDs) arranged in the sub-scanning direction, and the partition walls are provided to form a plurality of shielded portions extended in the main scanning direction.

9. The inkjet recording apparatus of claim 7, wherein a concave portion is provided on a side of the ultraviolet irradiating means facing the recording medium, the light sources are provided on a bottom surface of the concave portion, and the partition walls are provided such that the shielded portions extends from the bottom surface to an opening area of the concave portion.

10. The inkjet recording apparatus of claim 7, further comprising a light controller turning on and off the light sources.

11. The inkjet recording apparatus of claim 7, wherein the ultraviolet irradiating means is provided in at least one of front and rear regions of the ink nozzles in the main scanning direction.

* * * * *